US007765104B2

(12) United States Patent
Pang et al.

(10) Patent No.: US 7,765,104 B2
(45) Date of Patent: Jul. 27, 2010

(54) SLOT POSITION CODING OF RESIDUAL SIGNALS OF SPATIAL AUDIO CODING APPLICATION

(75) Inventors: Hee Suk Pang, Seoul (KR); Dong Soo Kim, Seoul (KR); Jae Hyun Lim, Seoul (KR); Hyen O. Oh, Goyang-si (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 975 days.

(21) Appl. No.: 11/514,302

(22) Filed: Aug. 30, 2006

(65) Prior Publication Data

US 2007/0094036 A1 Apr. 26, 2007

Related U.S. Application Data

(60) Provisional application No. 60/712,119, filed on Aug. 30, 2005, provisional application No. 60/719,202, filed on Sep. 22, 2005, provisional application No. 60/723,007, filed on Oct. 4, 2005, provisional application No. 60/726,228, filed on Oct. 14, 2005, provisional application No. 60/729,225, filed on Oct. 24, 2005, provisional application No. 60/762,536, filed on Jan. 27, 2006.

(30) Foreign Application Priority Data

Jan. 13, 2006 (KR) ..... 10-2006-0004051
Jan. 13, 2006 (KR) ..... 10-2006-004055
Jan. 13, 2006 (KR) ..... 10-2006-0004057
Jan. 13, 2006 (KR) ..... 10-2006-0004062
Jan. 13, 2006 (KR) ..... 10-2006-0004063
Jan. 13, 2006 (KR) ..... 10-2006-0004065

(51) Int. Cl.
*G10L 19/00* (2006.01)

(52) U.S. Cl. ..... 704/500; 704/200; 704/201; 704/501

(58) Field of Classification Search ..... 704/200–201, 704/500, 501
See application file for complete search history.

(56) References Cited

U.S. PATENT DOCUMENTS 4,621,862 A 11/1986 Kramer (Continued)

FOREIGN PATENT DOCUMENTS

CN 1655651 8/2005

(Continued)

OTHER PUBLICATIONS

Notice of Allowance issued in corresponding Korean Application Serial No. 2008-7007453, dated Feb. 27, 2009 (no English translation available).

(Continued)

*Primary Examiner*—Richemond Dorvil
*Assistant Examiner*—Douglas C Godbold
(74) *Attorney, Agent, or Firm*—Fish & Richardson P.C.

(57) ABSTRACT

Spatial information associated with an audio signal is encoded into a bitstream, which can be transmitted to a decoder or recorded to a storage media. The bitstream can include different syntax related to time, frequency and spatial domains. In some embodiments, the bitstream includes one or more data structures (e.g., frames) that contain ordered sets of slots for which parameters can be applied. The data structures can be fixed or variable. The data structure can include position information that can be used by a decoder to identify the correct slot for which a given parameter set is applied. The slot position information can be encoded with either a fixed number of bits or a variable number of bits based on the data structure type.

6 Claims, 23 Drawing Sheets

U.S. PATENT DOCUMENTS 4,661,862 A 4/1987 Thompson
4,725,885 A 2/1988 Gonzales et al.
4,907,081 A 3/1990 Okamura et al.
5,243,686 A 9/1993 Tokuda et al.
5,481,643 A 1/1996 Ten Kate et al.
5,515,296 A 5/1996 Agarwal
5,528,628 A 6/1996 Park et al.
5,530,750 A 6/1996 Akagiri
5,563,661 A 10/1996 Takahashi et al.
5,579,430 A 11/1996 Grill et al.
5,606,618 A 2/1997 Lokhoff et al.
5,621,856 A 4/1997 Akagiri
5,640,159 A 6/1997 Fulran et al.
5,682,461 A 10/1997 Silzle et al.
5,687,157 A 11/1997 Imai et al.
5,890,125 A 3/1999 Davis et al.
5,912,636 A 6/1999 Gormish et al.
5,945,930 A 8/1999 Kajiwara
5,966,688 A 10/1999 Nandkumar et al.
5,974,380 A 10/1999 Smyth et al.
6,021,386 A 2/2000 Davis et al.
6,125,398 A 9/2000 Mirashrafi et al.
6,134,518 A 10/2000 Cohen et al.
6,148,283 A 11/2000 Das
6,208,276 B1 3/2001 Snyder
6,295,319 B1 9/2001 Sueyoshi et al.
6,309,424 B1 10/2001 Fallon
6,339,760 B1 1/2002 Koda et al.
6,384,759 B2 5/2002 Snyder
6,399,760 B1 6/2002 Gimeno et al.
6,421,467 B1 7/2002 Mitra
6,442,110 B1 8/2002 Yamamoto et al.
6,453,120 B1 9/2002 Takahashi et al.
6,456,966 B1 9/2002 Iwabuchi
6,556,685 B1 4/2003 Urry et al.
6,560,404 B1 * 5/2003 Okada et al. ..... 386/95
6,611,212 B1 8/2003 Craven et al.
6,631,352 B1 10/2003 Fujita et al.
6,636,830 B1 10/2003 Princen et al.
7,283,965 B1 10/2007 Michener
7,376,555 B2 5/2008 Schuijers et al.
7,394,903 B2 * 7/2008 Herre et al. ..... 381/23
7,519,538 B2 4/2009 Villemoes et al.
2001/0055302 A1 * 12/2001 Taylor et al. ..... 370/386
2002/0049586 A1 4/2002 Nishio et al.
2002/0106019 A1 8/2002 Chaddha et al.
2003/0009325 A1 1/2003 Kirchherr et al.
2003/0016876 A1 1/2003 Chai et al.
2003/0138157 A1 7/2003 Schwartz
2003/0195742 A1 10/2003 Tsushima
2003/0236583 A1 12/2003 Baumgarte et al.
2004/0049379 A1 3/2004 Thumpudi et al.
2004/0057523 A1 3/2004 Koto et al.
2004/0138895 A1 7/2004 Lokhoff et al.
2004/0186735 A1 * 9/2004 Ferris et al. ..... 704/500
2004/0199276 A1 * 10/2004 Poon ..... 700/94
2004/0247035 A1 12/2004 Schroder et al.
2005/0058304 A1 3/2005 Baumgarte et al.
2005/0074127 A1 4/2005 Herre et al.
2005/0074135 A1 4/2005 Kushibe
2005/0091051 A1 4/2005 Moriya et al.
2005/0114126 A1 5/2005 Geiger et al.
2005/0137729 A1 6/2005 Sakurai et al.
2005/0157883 A1 7/2005 Herre et al.
2005/0174269 A1 8/2005 Sherigar et al.
2005/0216262 A1 9/2005 Fejzo
2006/0023577 A1 2/2006 Shinoda et al.
2006/0085200 A1 * 4/2006 Allamanche et al. ..... 704/500
2006/0190247 A1 * 8/2006 Lindblom ..... 704/230
2007/0038439 A1 2/2007 Schiujers et al.
2007/0150267 A1 6/2007 Honma et al.
2009/0185751 A1 7/2009 Kudo et al.

FOREIGN PATENT DOCUMENTS

DE 69712383 1/2003
EP 372601 6/1990
EP 599825 6/1994
EP 0610975 8/1994
EP 827312 3/1998
EP 0943143 4/1999
EP 948141 10/1999
EP 957639 11/1999
EP 1001549 5/2000
EP 1047198 10/2000
EP 1376538 1/2004
EP 1396843 3/2004
EP 1869774 10/2006
EP 1905005 1/2007
GB 2238445 5/1991
GB 2340351 2/2002
JP 60-096079 5/1985
JP 62-094090 4/1987
JP 09-275544 10/1997
JP 11-205153 7/1999
JP 2001-188578 7/2001
JP 2001-53617 9/2002
JP 2002-328699 11/2002
JP 2002-335230 11/2002
JP 2003-005797 1/2003
JP 2003-233395 8/2003
JP 2004-170610 6/2004
JP 2004-220743 8/2004
JP 2005-063655 3/2005
JP 2005-332449 12/2005
JP 2006-120247 5/2006
KR 1997-0014387 3/1997
KR 2001-0001991 5/2001
KR 2003-0043620 6/2003
KR 2003-0043622 6/2003
RU 2158970 11/2000
RU 2214048 10/2003
RU 2221329 1/2004
RU 2005103637 7/2005
TW 204406 4/1993
TW 289885 11/1996
TW 317064 10/1997
TW 360860 6/1999
TW 378478 1/2000
TW 384618 3/2000
TW 405328 9/2000
TW 550541 9/2003
TW 567466 12/2003
TW 569550 1/2004
TW 200404222 3/2004
TW 1230530 4/2004
TW 200405673 4/2004
TW M257575 2/2005
WO WO 95/27337 10/1995
WO 97/40630 10/1997
WO 99/52326 10/1999
WO WO 99/56470 11/1999
WO 00/02357 1/2000
WO 00/60746 10/2000
WO WO 00/79520 12/2000
WO WO 03/046889 6/2003
WO 03/090028 10/2003
WO 03/090206 10/2003
WO 03/090207 10/2003
WO WO 03/088212 10/2003
WO 2004/008806 1/2004
WO 2004/028142 4/2004
WO WO2004072956 8/2004
WO 2004/080125 9/2004

| | | |
|---|---|---|
| WO | WO 2004/093495 | 10/2004 |
| WO | WO 2005/043511 | 5/2005 |
| WO | 2005/059899 | 6/2005 |
| WO | WO 2006/048226 | 5/2006 |
| WO | WO 2006/108464 | 10/2006 |

OTHER PUBLICATIONS

Bessette B, et al.: Universal Speech/Audio Coding Using Hybrid ACELP/TCX Techniques, 2005, 4 pages.
Boltze Th. Et al.; "Audio services and applications." In: Digital Audio Broadcasting. Edited by Hoeg, W. and Lauferback, Th. ISBN 0-470-85013-2. John Wiley & Sons Ltd., 2003. pp. 75-83.
Breebaart, J., AES Convention Paper 'MPEG Spatial audio coding/MPEG surround: Overview and Current Status', 119th Convention, Oct. 7-10, 2005, New York, New York, 17 pages.
Chou, J. et al.: Audio Data Hiding with Application to Surround Sound, 2003, 4 pages.
Faller C., et al.: Binaural Cue Coding—Part II: Schemes and Applications, 2003, 12 pages, IEEE Transactions on Speech and Audio Processing, vol. 11, No. 6.
Faller C.: Parametric Coding of Spatial Audio. Doctoral thesis No. 3062, 2004, 6 pages.
Faller, C: "Coding of Spatial Audio Compatible with Different Playback Formats", Audio Engineering Society Convention Paper, 2004, 12 pages, San Francisco, CA.
Hamdy K.N., et al.: Low Bit Rate High Quality Audio Coding with Combined Harmonic and Wavelet Representations, 1996, 4 pages.
Heping, D.,: Wideband Audio Over Narrowband Low-Resolution Media, 2004, 4 pages.
Herre, J. et al.: MP3 Surround: Efficient and Compatible Coding of Multi-channel Audio, 2004, 14 pages.
Herre, J. et al: The Reference Model Architecture for MPEG Spatial Audio Coding, 2005, 13 pages, Audio Engineering Society Convention Paper.
Hosoi S., et al.: Audio Coding Using the Best Level Wavelet Packet Transform and Auditory Masking, 1998, 4 pages.
International Search Report corresponding to International Application No. PCT/KR2006/002018 dated Oct. 16, 2006, 1 page.
International Search Report corresponding to International Application No. PCT/KR2006/002019 dated Oct. 16, 2006, 1 page.
International Search Report corresponding to International Application No. PCT/KR2006/002020 dated Oct. 16, 2006, 2 pages.
International Search Report corresponding to International Application No. PCT/KR2006/002021 dated Oct. 16, 2006, 1 page.
International Search Report corresponding to International Application No. PCT/KR2006/002575, dated Jan. 12, 2007, 2 pages.
International Search Report corresponding to International Application No. PCT/KR2006/002578, dated Jan. 12, 2007, 2 pages.
International Search Report corresponding to International Application No. PCT/KR2006/002579, dated Nov. 24, 2006, 1 page.
International Search Report corresponding to International Application No. PCT/KR2006/002581, dated Nov. 24, 2006, 2 pages.
International Search Report corresponding to International Application No. PCT/KR2006/002583, dated Nov. 24, 2006, 2 pages.
International Search Report corresponding to International Application No. PCT/KR2006/003420, dated Jan. 18, 2007, 2 pages.
International Search Report corresponding to International Application No. PCT/KR2006/003424, dated Jan. 31, 2007, 2 pages.
International Search Report corresponding to International Application No. PCT/KR2006/003426, dated Jan. 18, 2007, 2 pages.
International Search Report corresponding to International Application No. PCT/KR2006/003435, dated Dec. 13, 2006, 1 page.
International Search Report corresponding to International Application No. PCT/KR2006/003975, dated Mar. 13, 2007, 2 pages.
International Search Report corresponding to International Application No. PCT/KR2006/004014, dated Jan. 24, 2007, 1 page.
International Search Report corresponding to International Application No. PCT/KR2006/004017, dated Jan. 24, 2007, 1 page.
International Search Report corresponding to International Application No. PCT/KR2006/004020, dated Jan. 24, 2007, 1 page.
International Search Report corresponding to International Application No. PCT/KR2006/004024, dated Jan. 29, 2007, 1 page.
International Search Report corresponding to International Application No. PCT/KR2006/004025, dated Jan. 29, 2007, 1 page.
International Search Report corresponding to International Application No. PCT/KR2006/004027, dated Jan. 29, 2007, 1 page.
International Search Report corresponding to International Application No. PCT/KR2006/004032, dated Jan. 24, 2007, 1 page.
International Search Report in corresponding International Application No. PCT/KR2006/004023, dated Jan. 23, 2007, 1 page.
ISO/IEC 13818-2, Generic Coding of Moving Pictures and Associated Audio, Nov. 1993, Seoul, Korea.
ISO/IEC 14496-3 Information Technology—Coding of Audio-Visual Objects—Part 3: Audio, Second Edition (ISO/IEC), 2001.
Jibra A., et al.: Multi-layer Scalable LPC Audio Format; ISACS 2000, 4 pages, IEEE International Symposium on Circuits and Systems.
Jin C, et al.: Individualization in Spatial-Audio Coding, 2003, 4 pages, IEEE Workshop on Applications of Signal Processing to Audio and Acoustics.
Kostantinides K: An introduction to Super Audio CD and DVD-Audio, 2003, 12 pages, IEEE Signal Processing Magazine.
Liebchem, T.; Reznik, Y.A.: MPEG-4: an Emerging Standard for Lossless Audio Coding, 2004, 10 pages, Proceedings of the Data Compression Conference.
Ming, L.: A novel random access approach for MPEG-1 multicast applications, 2001, 5 pages.
Moon, Han-gil, et al.: A Multi-Channel Audio Compression Method with Virtual Source Location Information for MPEG-4 SAC, IEEE 2005, 7 pages.
Moriya T., et al.,: A Design of Lossless Compression for High-Quality Audio Signals, 2004, 4 pages.
Notice of Allowance dated Aug. 25, 2008 by the Korean Patent Office for counterpart Korean Appln. Nos. 2008-7005851, 7005852; and 7005858.
Notice of Allowance dated Dec. 26, 2008 by the Korean Patent Office for counterpart Korean Appln. Nos. 2008-7005836, 7005838, 7005839, and 7005840.
Notice of Allowance dated Jan. 13, 2009 by the Korean Patent Office for a counterpart Korean Appln. No. 2008-7005992.
Office Action dated Jul. 21, 2008 issued by the Taiwan Patent Office, 16 pages.
Oh, E. et al.: Proposed changes in MPEG-4 BSAC multi channel audio coding, 2004, 7 pages, International Organisation for Standardisation.
Pang, H., et al., "Extended Pilot-Based Codling for Lossless Bit Rate Reduction of MPEG Surround", ETRI Journal, vol. 29, No. 1, Feb. 2007.
Puri, A., et al.: MPEG-4: An object-based multimedia coding standard supporting mobile applications, 1998, 28 pages, Baltzer Science Publishers BV.
Said, A.: On the Reduction of Entropy Coding Complexity via Symbol Grouping: I—Redundancy Analysis and Optimal Alphabet Partition, 2004, 42 pages, Hewlett-Packard Company.
Schroeder E F et al: Der MPEG-2Standard: Generische Codierung fur Bewegtbilder und zugehorige Audio-Information, 1994, 5 pages.
Schuijers, E. et al: Low Complexity Parametric Stereo Coding, 2004, 6 pages, Audio Engineering Society Convention Paper 6073.
Stoll, G.: MPEG Audio Layer II: A Generic Coding Standard for Two and Multichannel Sound for DVB, DAB and Computer Multimedia, 1995, 9 pages, International Broadcasting Convention, XP006528918.
Supplementary European Search Report corresponding to Application No. EP06747465, dated Oct. 10, 2008, 8 pages.
Supplementary European Search Report corresponding to Application No. EP06747467, dated Oct. 10, 2008, 8 pages.
Supplementary European Search Report corresponding to Application No. EP06757755, dated Aug. 1, 2008, 1 page.
Supplementary European Search Report corresponding to Application No. EP06843795, dated Aug. 7, 2008, 1 page.
Ten Kate W. R. Th., et al.: A New Surround-Stereo-Surround Coding Technique, 1992, 8 pages, J. Audio Engineering Society, XP002498277.
Voros P.: High-quality Sound Coding within 2×64 kbit/s Using Instantaneous Dynamic Bit-Allocation, 1988, 4 pages.

Webb J., et al.: Video and Audio Coding for Mobile Applications, 2002, 8 pages, The Application of Programmable DSPs in Mobile Communications.
Faller, Christof, "Parametric Coding of Spatial Audio", Proceedings of the 7th Int. Conferences on Digital Audio Efffects (DAFx'04), Naples, Italy, Oct. 5-8, 2004, 6 pages.
Herre, J., et al., "The reference model architecture for MPEG spatial audio coding", Convention Paper 6447, Audio Engineering Society (AES) 118th Convention, Barcelona, Spain, May 28-31, 2005, 13 pages.
"Text of second working draft for MPEG Surround", ISO/IEC JTC 1/SC 29/WG 11, No. N7387, No. N7387, Jul. 29, 2005, 140 pages.
Deputy Chief of the Electrical and Radio Engineering Department Makhotna, S.V., Russian Decision on Grant Patent for Russian Patent Application No. 2008112226 dated Jun. 5, 2009, and its translation, 15 pages.
Extended European search report for European Patent Application No. 06799105.9 dated Apr. 28, 2009, 11 pages.
Supplementary European Search Report for European Patent Application No. 06799058 dated Jun. 16, 2009, 6 pages.
Supplementary European Search Report for European Patent Application No. 06757751 dated Jun. 8, 2009, 5 pages.
Herre, J. et al., "Overview of MPEG-4 audio and its applications in mobile communication", Communication Technology Proceedings, 2000. WCC—ICCT 2000. International Confrence on Beijing, China held Aug. 21-25, 2000, Piscataway, NJ, USA, IEEE, US, vol. 1 (Aug. 21, 2008), pp. 604-613.
Oh, H-O et al., "Proposed core experiment on pilot-based coding of spatial parameters for MPEG surround", ISO/IEC JTC 1/SC 29/WG 11, No. M12549, Oct. 13, 2005, 18 pages XP030041219.
Pang, H-S, "Clipping Prevention Scheme for MPEG Surround", ETRI Journal, vol. 30, No. 4 (Aug. 1, 2008), pp. 606-608.
Quackenbush, S. R. et al., "Noiseless coding of quantized spectral components in MPEG-2 Advanced Audio Coding", Application of Signal Processing to Audio and Acoustics, 1997. 1997 IEEE ASSP Workshop on New Paltz, NY, US held on Oct. 19-22, 1997, New York, NY, US, IEEE, US, (Oct. 19, 1997), 4 pages.
Russian Decision on Grant Patent for Russian Patent Application No. 2008103314 dated Apr. 27, 2009, and its translation, 11 pages.
USPTO Non-Final Office Action in U.S. Appl. No. 12/088,868, mailed Apr. 1, 2009, 11 pages.
USPTO Non-Final Office Action in U.S. Appl. No. 12/088,872, mailed Apr. 7, 2009, 9 pages.
USPTO Non-Final Office Action in U.S. Appl. No. 12/089,383, mailed Jun. 25, 2009, 5 pages.
USPTO Non-Final Office Action in U.S. Appl. No. 11/540,920, mailed Jun. 2, 2009, 8 pages.
USPTO Non-Final Office Action in U.S. Appl. No. 12/089,105, mailed Apr. 20, 2009, 5 pages.
USPTO Non-Final Office Action in U.S. Appl. No. 12/089,093, mailed Jun. 16, 2009, 10 pages.
Notice of Allowance dated Sep. 25, 2009 issued in U.S. Appl. No. 11/540,920.
Office Action dated Jul. 14, 2009 issued in Taiwan Application No. 095136561.
Notice of Allowance dated Apr. 13, 2009 issued in Taiwan Application No. 095136566.
Bosi, M., et al. "ISO/IEC MPEG-2 Advanced Audio Coding." *Journal of the Audio Engineering Society* 45.10 (Oct. 1, 1997): 789-812. XP000730161.
Ehrer, A., et al. "Audio Coding Technology of ExAC." *Proceedings Of 2004 International Symposium On Hong Kong, China* Oct. 20, 2004, Piscataway, New Jersey. IEEE, 290-293. XP010801441.
European Search Report & Written Opinion for Application No. EP 06799113.3, dated Jul. 20, 2009, 10 pages.
European Search Report & Written Opinion for Application No. EP 06799111.7 dated Jul. 10, 2009, 12 pages.
European Search Report & Written Opinion for Application No. EP 06799107.5, dated Aug. 24, 2009, 6 pages.
European Search Report & Written Opinion for Application No. EP 06799108.3, dated Aug. 24, 2009, 7 pages.
International Preliminary Report on Patentability for Application No. PCT/KR2006/004332, dated Jan. 25, 2007, 3 pages.
Korean Intellectual Property Office Notice of Allowance for No. 10-2008-7005993, dated Jan. 13, 2009, 3 pages.
Russian Notice of Allowance for Application No. 2008112174, dated Sep. 11, 2009, 13 pages.
Schuller, Gerald D.T., et al. "Perceptual Audio Coding Using Adaptive Pre- and Post-Filters and Lossless Compression." *IEEE Transactions on Speech and Audio Processing* New York, 10.6 (Sep. 1, 2002): 379. XP011079662.
Taiwanese Office Action for Application No. 095124113, dated Jul. 21, 2008, 13 pages.
Taiwanese Notice of Allowance for Application No. 95124070, dated Sep. 18, 2008, 7 pages.
Taiwanese Notice of Allowance for Application No. 95124112, dated Jul. 20, 2009, 5 pages.
Tewfik, A.H., et al. "Enhance wavelet based audio coder." *IEEE*. (1993): 896-900. XP010096271.
USPTO Notice of Allowance in U.S. Appl. No. 12/089,098, mailed Sep. 8, 2009, 19 pages.
U.S. Patent and Trademark Office Final Office Action of U.S. Appl. No. 11/513,896 dated Dec. 30, 2009, 19 pages.

* cited by examiner

FIG. 7A

| | Syntax | No. of bits |
|---|---|---|
| | SpatialSpecificConfig() | |
| | { | |
| 701 | bsSamplingFrequencyIndex; | 4 |
| | if ( bsSamplingFrequencyIndex == 0xf ) { | |
| 702 | bsSamplingFrequency; | 24 |
| | } | |
| 703 | bsFrameLength; | 7 |
| 704 | bsFreqRes; | 3 |
| 705 | bsTreeConfig; | 4 |
| 706 | bsQuantMode; | 3 |
| 707 | bsOneIcc; | 1 |
| 708 | bsArbitraryDowmix; | 1 |
| 709 | bsFixedGainSur; | 3 |
| 710 | bsFixedGainLFE; | 3 |
| 711 | bsFixedGainDMX; | 3 |
| 712 | bsMatrixMode; | 1 |
| 713 | bsTempShapeConfig; | 4 |
| 714 | bsDecorrConfig; | 4 |
| 715 | bs3DaudioMode; | 1 |
| | ⋮ | |
| | for (i=0; i<numOttBoxes; i++) { | |
| 716 | OttConfig(i); | |
| | } | |
| | for (i=0; i<numTttBoxes; i++) { | |
| 717 | TttConfig(i); | |
| | } | |
| | ⋮ | |
| 718 | Spatial Extension Config() | |
| | } | |

FIG. 7B

| bsFreqRes | numBands |
|---|---|
| 0 | Reserved |
| 1 | 28 |
| 2 | 20 |
| 3 | 14 |
| 4 | 10 |
| 5 | 7 |
| 6 | 5 |
| 7 | 4 |

FIG. 8A

| | Syntax | No. of bits |
|---|---|---|
| | OttConfig(i) | |
| | { | |
| | if (ottModeLfe[i]) { | |
| 801 | bsOttBands[i]; | 5 |
| | } | |
| | else { | |
| | bsOttBands[i] = numBands; | |
| | } | |
| | } | |

FIG. 8B

| | Syntax | No. of bits |
|---|---|---|
| | OttConfig(i) | |
| | { | |
| | if (ottModeLfe[i]) { | |
| 802 | bsOttBands[i]; | Bitsnumbands |
| | } | |
| | else { | |
| | bsOttBands[i] = numBands; | |
| | } | |
| | } | |

Minimum number of bits for representation of numBands

FIG. 9A

| | Syntax | No. of bits |
|---|---|---|
| | TttConfig(i) | |
| | { | |
| 901 | bsTttDualMode[i]; | 1 |
| 902 | bsTttModeLow[i]; | 3 |
| | if (bsTttDualMode[i]) { | |
| 903 | bsTttModeHigh[i]; | 3 |
| 904 | bsTttBandsLow[i]; | 5 |
| 905 | bsTttBandsHigh[i] = numBands; | |
| | } | |
| | else { | |
| 906 | bsTttBandsLow[i] = numBands; | |
| | } | |

FIG. 9B

| Syntax | No. of bits |
|---|---|
| TttConfig(i) | |
| { | |
| bsTttDualMode[i]; | 1 |
| bsTttModeLow[i]; | 3 |
| if (bsTttDualMode[i]) { | |
| bsTttModeHigh[i]; | 3 |
| 907 bsTttBandsLow[i]; | BitsnumBands |
| bsTttBandsHigh[i] = numBands; | |
| } | |
| else { | |
| bsTttBandsLow[i] = numBands; | |
| } | |

Minimum number of bits for representation of numBands

FIG. 10A

| | Syntax | No. of bits |
|---|---|---|
| | SpatialExtensionConfig() | |
| | { | |
| | while (BitsAvailable() >= 8) { | |
| 1001 | bsSacExtType; | |
| 1002 | cnt = bsSacExtLen; | 4 |
| | if (cnt==15) { | 4 |
| 1003 | cnt += bsSacExtLenAdd; | 8 |
| | } | |
| | if (cnt==15+255) { | |
| 1004 | cnt += bsSacExtLenAddAdd; | 16 |
| | } | |
| 1005 | bitsRead = SpatialExtensionConfigData(bsSacExtType) | |
| 1006 | nFillBits = 8*cnt−bitsRead; | |
| 1007 | bsFillBits; | |
| | } | |
| | } | |
| | } | |

FIG. 10B

| | Syntax | No. of bits |
|---|---|---|
| | SpatialExtensionConfigData(1) | |
| | { | |
| 1008 | bsResidualSamplingFrequencyIndex; | 4 |
| 1009 | bsResidualFramesPerSpatialFrame; | 2 |
| | for (i=0; i<numOttBoxes+numTttBoxes; i++) { | |
| 1010 | ResidualConfig(i); | |
| | } | |
| | } | |

FIG. 10C

| | Syntax | No. of bits |
|---|---|---|
| | ResidualConfig(i) | |
| | { | |
| 1011 | bsResidualPresent[i]; | 1 |
| | if (bsResidualPresent[i]) { | |
| 1012 | bsResidualBands[i]; | 5 |
| | } | |
| | } | |
| | | |

FIG. 10D

| | Syntax | No. of bits |
|---|---|---|
| | ResidualConfig(i) | |
| | { | |
| 1013 | bsResidualPresent[i]; | 1 |
| | if (bsResidualPresent[i]) { | |
| 1014 | bsResidualBands[i]; | BitsnumBands |
| | } | |
| | } | |

Minimum number of bits for representation of numBands

FIG. 12

| | Syntax | No. of bits |
|---|---|---|
| | SpatialFrame() | |
| | { | |
| 1201 | FramingInfo(); | |
| 1202 | bsIndependencyFlag; | 1 |
| 1203 | OttData(); | |
| 1204 | TttData(); | |
| 1205 | SmgData(); | |
| 1206 | TempShapeData(); | |
| | } | |

FIG. 13A

| Syntax | No. of bits |
|---|---|
| FramingInfo() | |
| { | |
| bsFramingType; | 1 |
| bsNumParamSets; | 3 |
| if (bsFramingType) { | |
| for (ps=0; ps<numParamSets; ps++) { | |
| bsParamSlot[ps]; | BitsnumSlots |
| ~ | |
| ~ | |
| ~ | |

1301

1302

1303

Minimum number of bits for representation of numSlots

FIG. 13B

| | Syntax | No. of bits |
|---|---|---|
| | FramingInfo() | |
| | { | |
| | bsFramingType; | |
| | bsNumParamSets; | 1 |
| | if (bsFramingType) { | 3 |
| | for (ps=0; ps<numParamSets; ps++) { | |
| | if(ps==0){ | |
| 1304 | bsParamSlot[0]; | nBitsParamSlot(0) |
| | else{ | |
| 1305 | bsDiffParamSlot[ps]; | nBitsParamSlot(ps) |
| 1306 | bsParamSlot[ps] = bsParamSlot[ps-1] + bsDiffParamSlot[ps] + 1; | |
| | } | |
| | } | |
| | } | |
| | } | |

SLOT POSITION CODING OF RESIDUAL SIGNALS OF SPATIAL AUDIO CODING APPLICATION

CROSS-RELATED APPLICATIONS

This patent application claims the benefit of priority from the following Korean and U.S. patent applications:

Korean Patent No. 10-2006-0004051, filed Jan. 13, 2006;
Korean Patent No. 10-2006-0004057, filed Jan. 13, 2006;
Korean Patent No. 10-2006-0004062, filed Jan. 13, 2006;
Korean Patent No. 10-2006-0004063, filed Jan. 13, 2006;
Korean Patent No. 10-2006-0004055, filed Jan. 13, 2006;
Korean Patent No. 10-2006-0004065, filed Jan. 13, 2006;
U.S. Provisional Patent Application No. 60/712,119, filed Aug. 30, 2005;
U.S. Provisional Patent Application No. 60/719,202, filed Sep. 22, 2005;
U.S. Provisional Patent Application No. 60/723,007, filed Oct. 4, 2005;
U.S. Provisional Patent Application No. 60/726,228, filed Oct. 14, 2005;
U.S. Provisional Patent Application No. 60/729,225. filed Oct. 24, 2005; and
U.S. Provisional Patent Application No. 60/762,536, filed Jan. 27, 2006.

Each of these patent applications is incorporated by reference herein in its entirety.

TECHNICAL FIELD

The subject matter of this application is generally related to audio signal processing.

BACKGROUND

Efforts are underway to research and develop new approaches to perceptual coding of multi-channel audio, commonly referred to as Spatial Audio Coding (SAC). SAC allows transmission of multi-channel audio at low bit rates, making SAC suitable for many popular audio applications (e.g., Internet streaming, music downloads).

Rather than performing a discrete coding of individual audio input channels, SAC captures the spatial image of a multi-channel audio signal in a compact set of parameters. The parameters can be transmitted to a decoder where the parameters are used to synthesis or reconstruct the spatial properties of the audio signal.

In some SAC applications, the spatial parameters are transmitted to a decoder as part of a bitstream. The bitstream includes spatial frames that contain ordered sets of time slots for which spatial parameter sets can be applied. The bitstream also includes position information that can be used by a decoder to identify the correct time slot for which a given parameter set is applied.

Some SAC applications make use of conceptual elements in the encoding/decoding paths. One element is commonly referred to as One-To-Two (OTT) and another element is commonly referred to as Two-To-Three (TTT), where the names imply the number of input and output channels of a corresponding decoder element, respectively. The OTT encoder element extracts two spatial parameters and creates a downmix signal and residual signal. The TTT element mixes down three audio signals into a stereo downmix signal plus a residual signal. These elements can be combined to provide a variety of configurations of a spatial audio sound environment (e.g., surround sound).

Some SAC applications can operate in a non-guided operation mode, where only a stereo downmix signal is transmitted from an encoder to a decoder without a need for spatial parameter transmission. The decoder synthesizes spatial parameters from the downmix signal and uses those parameters to produce a multi-channel audio signal.

SUMMARY

Spatial information associated with an audio signal is encoded into a bitstream, which can be transmitted to a decoder or recorded to a storage media. The bitstream can include different syntax related to time, frequency and spatial domains. In some embodiments, the bitstream includes one or more data structures (e.g., frames) that contain ordered sets of slots for which parameters can be applied. The data structures can be fixed or variable. A data structure type indicator can be inserted in the bitstream to enable a decoder to determine the data structure type and to invoke an appropriate decoding process. The data structure can include position information that can be used by a decoder to identify the correct slot for which a given parameter set is applied. The slot position information can be encoded with either a fixed number of bits or a variable number of bits based on the data structure type as indicated by the data structure type indicator. For variable data structure types, the slot position information can be encoded with a variable number of bits based on the position of the slot in the ordered set of slots.

In some embodiments, a method of encoding an audio signal includes: generating a parameter set corresponding to first or second information of an audio signal; generating a residual signal corresponding to a range of the first or second information; and inserting the parameter set and the residual signal in a bitstream representing the audio signal, wherein the first or second information is represented by a variable number of bits.

In some embodiments, a method of decoding an audio signal includes: receiving a bit stream representing an audio signal, the bitstream including a parameter set corresponding to first or second information of the audio signal; receiving a residual signal corresponding to a range of the first or second information; and decoding the audio signal based on the parameter set and the residual signal, wherein the first or second information is represented by a variable number of bits.

Other embodiments of time slot position coding of multiple frame types are disclosed that are directed to systems, methods, apparatuses, data structures and computer-readable mediums.

It is to be understood that both the foregoing general description and the following detailed description of the embodiments are exemplary and explanatory and are intended to provide further explanation of the invention as claimed.

DESCRIPTION OF DRAWINGS

The accompanying drawings, which are included to provide a further understanding of the invention and are incorporated in and constitute part of this application, illustrate embodiment(s) of the invention, and together with the description, serve to explain the principle of the invention. In the drawings:

FIG. 7A illustrates a syntax for representing configuration information of a spatial information signal according to one embodiment of the present invention;

FIG. 7B is a table for a number of parameter bands of a spatial information signal according to one embodiment of the present invention;

FIG. 8A illustrates a syntax for representing a number of parameter bands applied to an OTT box as a fixed number of bits according to one embodiment of the present invention;

FIG. 8B illustrates a syntax for representing a number of parameter bands applied to an OTT box by a variable number of bits according to one embodiment of the present invention;

FIG. 9A illustrates a syntax for representing a number of parameter bands applied to a TTT box by a fixed number of bits according to one embodiment of the present invention;

FIG. 9B illustrates a syntax for representing a number of parameter bands applied to a TTT box by a variable number of bits according to one embodiment of the present invention;

FIG. 10A illustrates a syntax of spatial extension configuration information for a spatial extension frame according to one embodiment of the present invention;

FIGS. 10B and 10C illustrate syntaxes of spatial extension configuration information for a residual signal in case that the residual signal is included in a spatial extension frame according to one embodiment of the present invention;

FIG. 10D illustrates a syntax for a method of representing a number of parameter bands for a residual signal according to one embodiment of the present invention;

FIG. 12 illustrates a syntax of configuration information of a spatial frame according to one embodiment of the present invention;

FIG. 13A illustrates a syntax of position information of a time slot to which a parameter set is applied according to one embodiment of the present invention;

FIG. 13B illustrates a syntax for representing position information of a time slot to which a parameter set is applied as an absolute value and a difference value according to one embodiment of the present invention;

DETAILED DESCRIPTION

Figure 1:
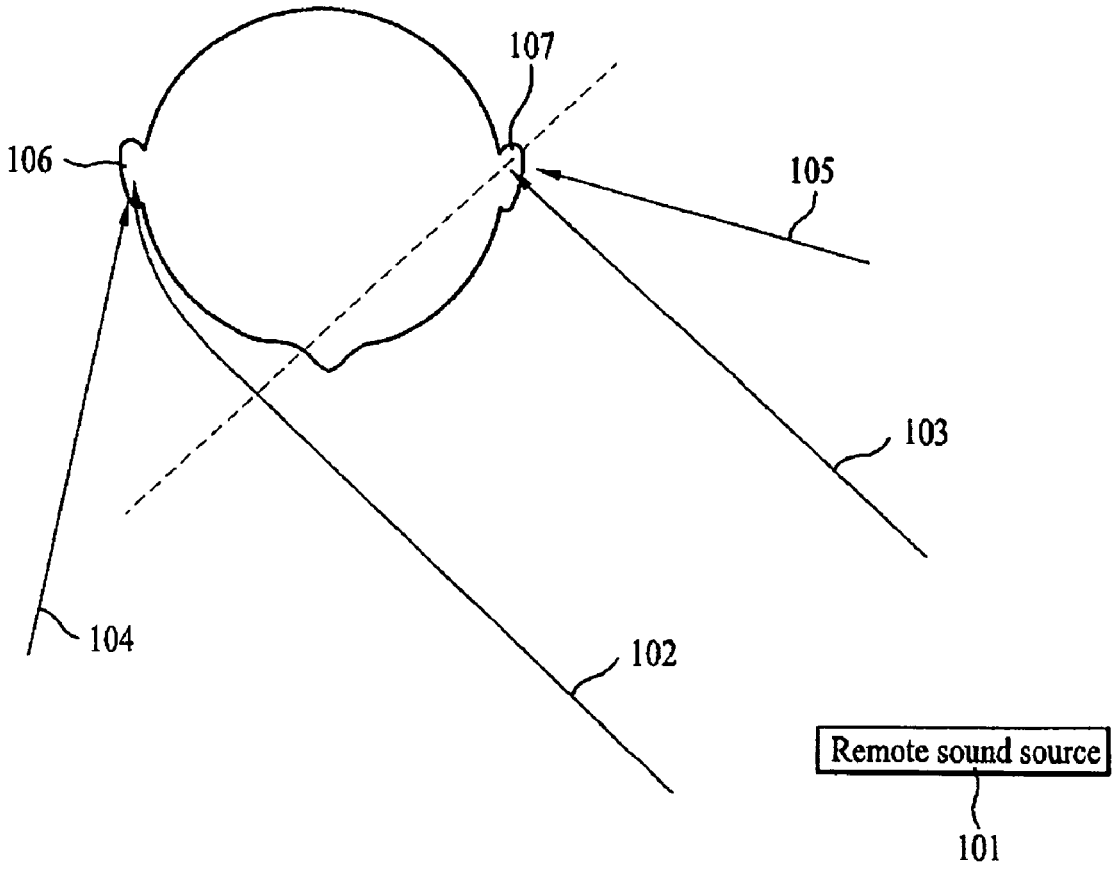
FIG. 1 is a diagram illustrating a principle of generating spatial information according to one embodiment of the present invention.

FIG. 1 is a diagram illustrating a principle of generating spatial information according to one embodiment of the present invention. Perceptual coding schemes for multi-channel audio signals are based on a fact that humans can perceive audio signals through three dimensional space. The three dimensional space of an audio signal can be represented using spatial information, including but not limited to the following known spatial parameters: Channel Level Differences (CLD), Inter-channel Correlation/Coherence (ICC), Channel Time Difference (CTD), Channel Prediction Coefficients (CPC), etc. The CLD parameter describes the energy (level) differences between two audio channels, the ICC parameter describes the amount of correlation or coherence between two audio channels and the CTD parameter describes the time difference between two audio channels.

The generation of CTD and CLD parameters is illustrated in FIG. 1. A first direct sound wave 103 from a remote sound source 101 arrives at a left human ear 107 and a second direct sound wave 102 is diffracted around a human head to reach a right human ear 106. The direct sound waves 102 and 103 differ from each other in arrival time and energy level. CTD and CLD parameters can be generated based on the arrival time and energy level differences of the sound waves 102 and 103, respectively. In addition, reflected sound waves 104 and 105 arrive at ears 106 and 107, respectively, and have no mutual correlations. An ICC parameter can be generated based on the correlation between the sound waves 104 and 105.

At the encoder, spatial information (e.g., spatial parameters) are extracted from a multi-channel audio input signal and a downmix signal is generated. The downmix signal and spatial parameters are transferred to a decoder. Any number of audio channels can be used for the downmix signal, including but not limited to: a mono signal, a stereo signal or a multi-channel audio signal. At the decoder, a multi-channel up-mix signal is created from the downmix signal and the spatial parameters.

Figure 2:
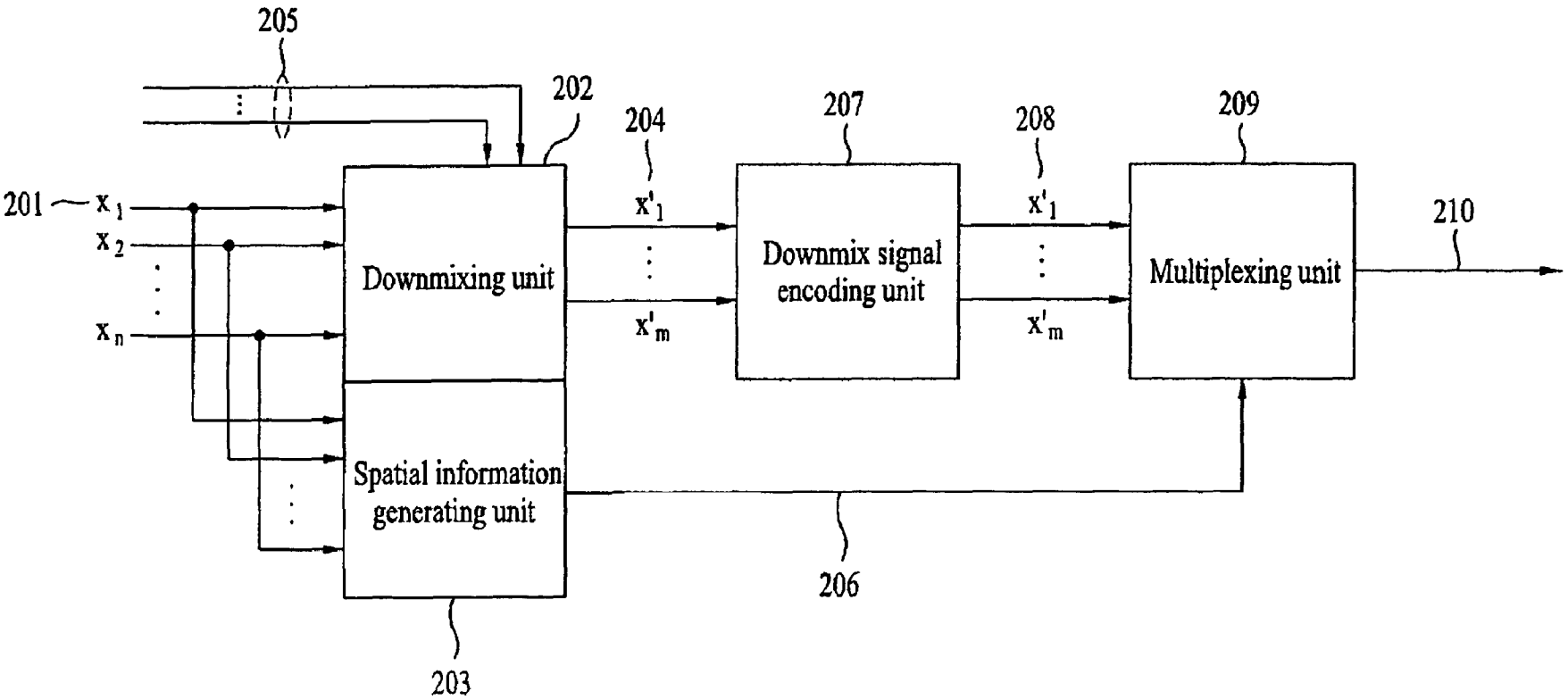
FIG. 2 is a block diagram of an encoder for encoding an audio signal according to one embodiment of the present invention.

FIG. 2 is a block diagram of an encoder for encoding an audio signal according to one embodiment of the present invention. The encoder includes a downmixing unit 202, a spatial information generating unit 203, a downmix signal encoding unit 207 and a multiplexing unit 209. Other configurations of an encoder are possible. Encoders can be implemented in hardware, software or a combination of both hardware and software. Encoders can be implemented in integrated circuit chips, chip sets, system on a chip (SoC), digital signal processors, general purpose processors and various digital and analog devices.

The downmixing unit 202 generates a downmix signal 204 from a multi-channel audio signal 201. In FIG. 2, $x_1, \ldots, x_n$ indicate input audio channels. As mentioned previously, the downmix signal 204 can be a mono signal, a stereo signal or a multi-channel audio signal. In the example shown, $x'_1, \ldots, x'_m$ indicate channel numbers of the downmix signal 204. In some embodiments, the encoder processes an externally provided downmix signal 205 (e.g., an artistic downmix) instead of the downmix signal 204.

The spatial information generating unit 203 extracts spatial information from the multi-channel audio signal 201. In this case, "spatial information" means information relating to the audio signal channels used in upmixing the downmix signal 204 to a multi-channel audio signal in the decoder. The downmix signal 204 is generated by downmixing the multi-channel audio signal. The spatial information is encoded to provide an encoded spatial information signal 206.

The downmix signal encoding unit 207 generates an encoded downmix signal 208 by encoding the downmix signal 204 generated from the downmixing unit 202.

The multiplexing unit 209 generates a bitstream 210 including the encoded downmix signal 208 and the encoded spatial information signal 206. The bitstream 210 can be transferred to a downstream decoder and/or recorded on a storage media.

Figure 3:
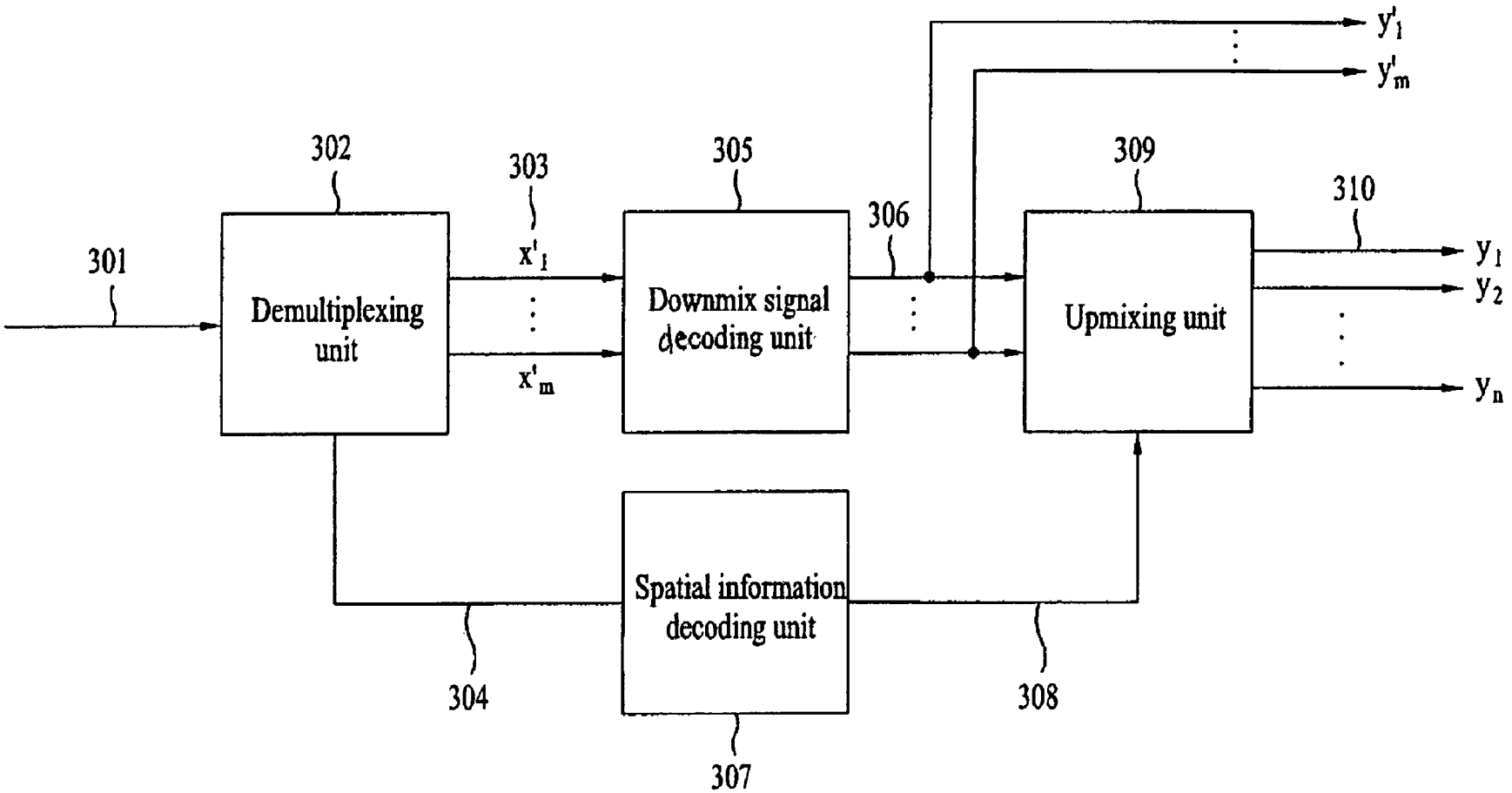
FIG. 3 is a block diagram of a decoder for decoding an audio signal according to one embodiment of the present invention.

FIG. 3 is a block diagram of a decoder for decoding an encoded audio signal according to one embodiment of the present invention. The decoder includes a demultiplexing unit 302, a downmix signal decoding unit 305, a spatial information decoding unit 307 and an upmixing unit 309. Decoders can be implemented in hardware, software or a combination of both hardware and software. Decoders can be implemented in integrated circuit chips, chip sets, system on a chip (SoC), digital signal processors, general purpose processors and various digital and analog devices.

In some embodiments, the demultiplexing unit 302 receives a bitstream 301 representing with an audio signal and then separates an encoded downmix signal 303 and an encoded spatial information signal 304 from the bitstream 301. In FIG. 3, $x'_1, \ldots, x'_m$ indicate channels of the downmix signal 303. The downmix signal decoding unit 305 outputs a decoded downmix signal 306 by decoding the encoded downmix signal 303. If the decoder is unable to output a multi-channel audio signal, the downmix signal decoding unit 305 can directly output the downmix signal 306. In FIG. 3, $y'_1, \ldots, y'_m$ indicate direct output channels of the downmix signal decoding unit 305.

The spatial information signal decoding unit 307 extracts configuration information of the spatial information signal from the encoded spatial information signal 304 and then decodes the spatial information signal 304 using the extracted configuration information.

The upmixing unit 309 can up mix the downmix signal 306 into a multi-channel audio signal 310 using the extracted spatial information 308. In FIG. 3, $y_1, \ldots, y_n$ indicate a number of output channels of the upmixing unit 309.

Figure 4:
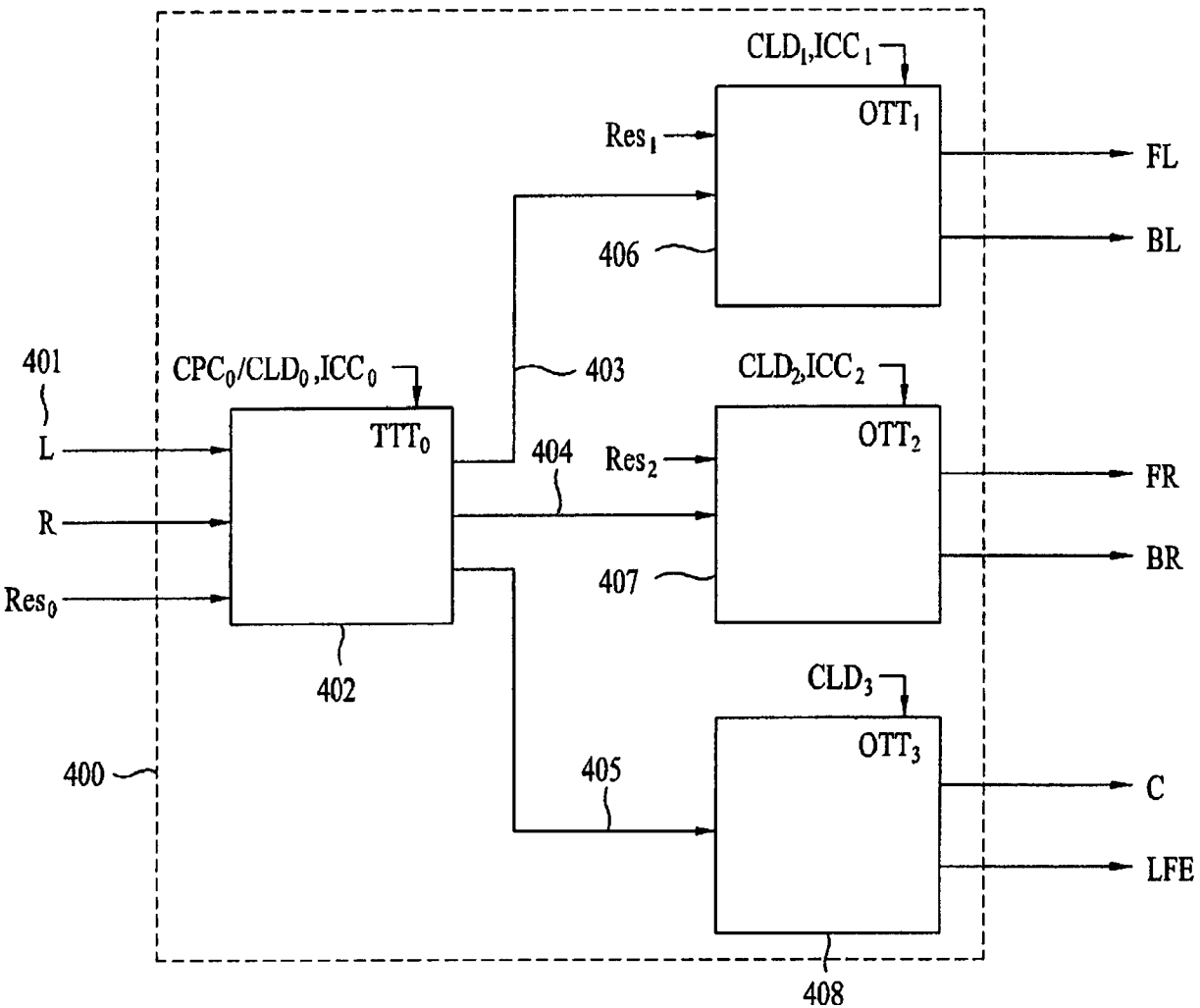
FIG. 4 is a block diagram of a channel converting module included in an upmixing unit of a decoder according to one embodiment of the present invention.

FIG. 4 is a block diagram of a channel converting module which can be included in the upmixing unit 309 of the decoder shown in FIG. 3. In some embodiments, the upmixing unit 309 can include a plurality of channel converting modules. The channel converting module is a conceptual device that can differentiate a number of input channels and a number of output channels from each other using specific information.

In some embodiments, the channel converting module can include an OTT (one-to-two) box for converting one channel to two channels and vice versa, and a TTT (two-to-three) box for converting two channels to three channels and vice versa. The OTT and/or TTT boxes can be arranged in a variety of useful configurations. For example, the upmixing unit 309 shown in FIG. 3 can include a 5-1-5 configuration, a 5-2-5 configuration, a 7-2-7 configuration, a 7-5-7 configuration etc. In a 5-1-5 configuration, a downmix signal having one channel is generated by downmixing five channels to a one channel, which can then be upmixed to five channels. Other configurations can be created in the same manner using various combinations of OTT and TTT boxes.

Referring to FIG. 4, an exemplary 5-2-5 configuration for an upmixing unit 400 is shown. In a 5-2-5 configuration, a downmix signal 401 having two channels is input to the upmixing unit 400. In the example shown, a left channel (L) and a right channel (R) are provided as input into the upmixing unit 400. In this embodiment, the upmixing unit 400 includes one TTT box 402 and three OTT boxes 406, 407 and 408. The downmix signal 401 having two channels is provided as input to the TTT box (TTTo) 402, which processes the downmix signal 401 and provides as output three channels 403, 404 and 405. One or more spatial parameters (e.g., CPC, CLD, ICC) can be provided as input to the TTT box 402, and are used to process the downmix signal 401, as described below. In some embodiments, a residual signal can be selectively provided as input to the TTT box 402. In such a case, the CPC can be described as a prediction coefficient for generating three channels from two channels.

The channel 403 that is provided as output from TTT box 402 is provided as input to OTT box 406 which generates two output channels using one or more spatial parameters. In the example shown, the two output channels represent front left (FL) and backward left (BL) speaker positions in, for example, a surround sound environment. The channel 404 is provided as input to OTT box 407, which generates two output channels using one or more spatial parameters. In the example shown, the two output channels represent front right (FR) and back right (BR) speaker positions. The channel 405 is provided as input to OTT box 408, which generates two output channels. In the example shown, the two output channels represent a center (C) speaker position and low frequency enhancement (LFE) channel. In this case, spatial information (e.g., CLD, ICC) can be provided as input to each of the OTT boxes. In some embodiments, residual signals (Res1, Res2) can be provided as inputs to the OTT boxes 406 and 407. In such an embodiment, a residual signal may not be provided as input to the OTT box 408 that outputs a center channel and an LFE channel.

The configuration shown in FIG. 4 is an example of a configuration for a channel converting module. Other configurations for a channel converting module are possible, including various combinations of OTT and TTT boxes. Since each of the channel converting modules can operate in a frequency domain, a number of parameter bands applied to each of the channel converting modules can be defined. A parameter band means at least one frequency band applicable to one parameter. The number of parameter bands is described in reference to FIG. 6B.

Figure 5:
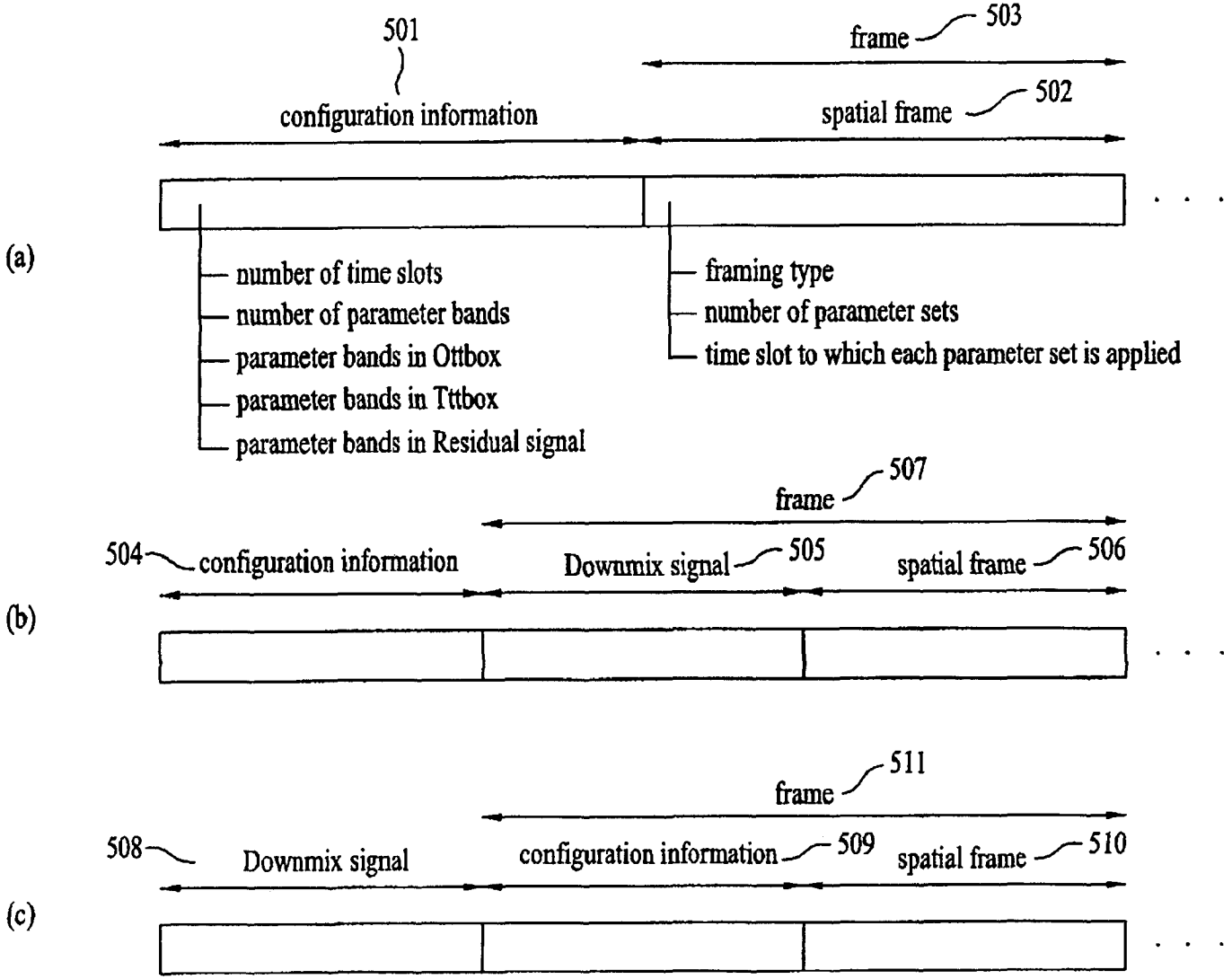
FIG. 5 is a diagram for explaining a method of configuring a bitstream of an audio signal according to one embodiment of the present invention.

FIG. 5 is a diagram illustrating a method of configuring a bitstream of an audio signal according to one embodiment of the present invention. FIG. 5(*a*) illustrates a bitstream of an audio signal including a spatial information signal only, and FIGS. 5(*b*) and 5(*c*) illustrate a bitstream of an audio signal including a downmix signal and a spatial information signal.

Referring to FIG. 5(*a*), a bitstream of an audio signal can include configuration information 501 and a frame 503. The frame 503 can be repeated in the bitstream and in some embodiments includes a single spatial frame 502 containing spatial audio information.

In some embodiments, the configuration information 501 includes information describing a total number of time slots within one spatial frame 502, a total number of parameter bands spanning a frequency domain of the audio signal, a number of parameter bands in an OTT box, a number of parameter bands in a TTT box and a number of parameter bands in a residual signal. Other information can be included in the configuration information 501 as desired.

In some embodiments, the spatial frame 502 includes one or more spatial parameters (e.g., CLD, ICC), a frame type, a number of parameter sets within one frame and time slots to which parameter sets can be applied. Other information can be included in the spatial frame 502 as desired. The meaning and usage of the configuration information 501 and the information contained in the spatial frame 502 will be explained in reference to FIGS. 6 to 10.

Referring to FIG. 5(*b*), a bitstream of an audio signal may include configuration information 504, a downmix signal 505 and a spatial frame 506. In this case, one frame 507 can include the downmix signal 505 and the spatial frame 506, and the frame 507 may be repeated in the bitstream.

Referring to FIG. 5(*c*), a bitstream of an audio signal may include a downmix signal 508, configuration information 509 and a spatial frame 510. In this case, one frame 511 can include the configuration information 509 and the spatial frame 510, and the frame 511 may be repeated in the bitstream. If the configuration information 509 is inserted in each frame 511, the audio signal can be played back by a playback device at an arbitrary position.

Although FIG. 5(*c*) illustrates that the configuration information 509 is inserted in the bitstream by frame 511, it should be apparent that the configuration information 509 can be inserted in the bitstream by a plurality of frames which repeat periodically or non-periodically.

Figure 6A:
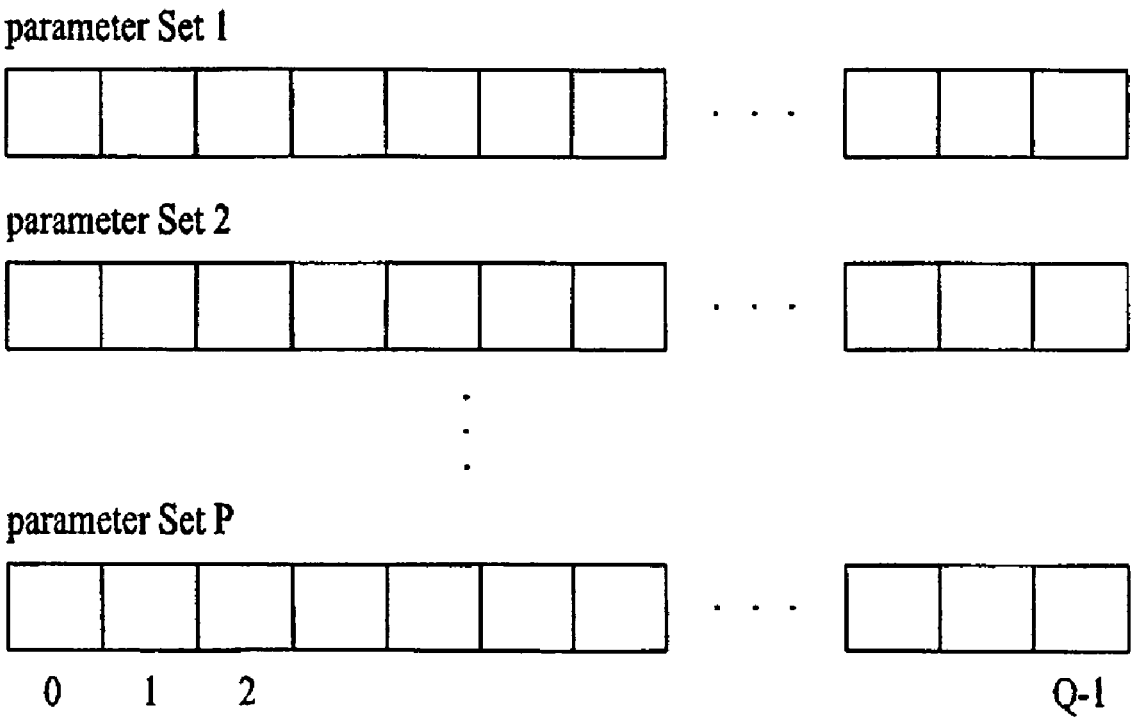
FIGS. 6A and 6B are a diagram and a time/frequency graph, respectively, for explaining relations between a parameter set, time slot and parameter bands according to one embodiment of the present invention.
Figure 6B:
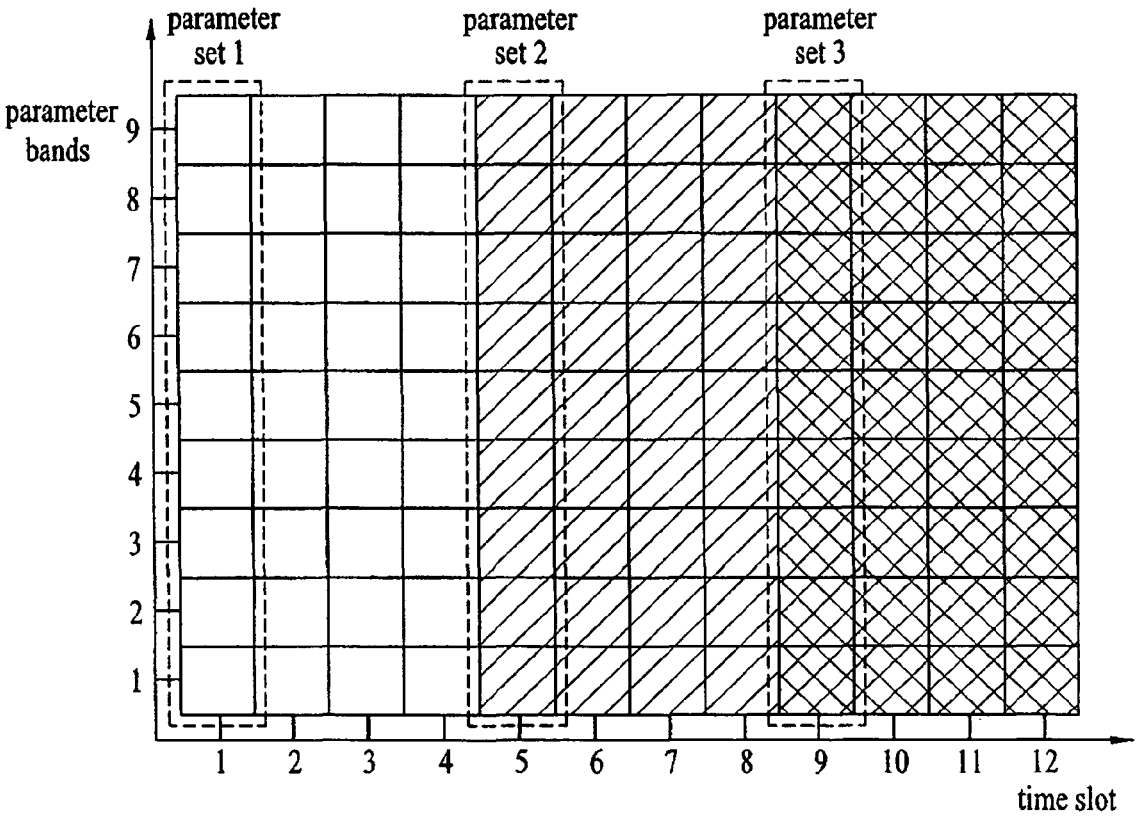

FIGS. 6A and 6B are diagrams illustrating relations between a parameter set, time slot and parameter bands according to one embodiment of the present invention. A parameter set means one or more spatial parameters applied to one time slot. The spatial parameters can include spatial information, such as CDL, ICC, CPC, etc. A time slot means a time interval of an audio signal to which spatial parameters can be applied. One spatial frame can include one or more time slots.

Referring to FIG. 6A, a number of parameter sets 1, . . . , P can be used in a spatial frame, and each parameter set can include one or more data fields 1, . . . , Q-1. A parameter set can be applied to an entire frequency domain of an audio signal, and each spatial parameter in the parameter set can be applied to one or more portions of the frequency band. For example, if a parameter set includes 20 spatial parameters, the entire frequency band of an audio signal can be divided into 20 zones (hereinafter referred to as "parameter bands") and the 20 spatial parameters of the parameter set can be applied to the 20 parameter bands. The parameters can be applied to the parameter bands as desired. For example, the spatial parameters can be densely applied to low frequency parameter bands and sparsely applied to high frequency parameter bands.

Referring to FIG. 6B, a time/frequency graph shows the relationship between parameter sets and time slots. In the example shown, three parameter sets (parameter set 1, parameter set 2, parameter set 3) are applied to an ordered set of 12 time slots in a single spatial frame. In this case, an entire frequency domain of an audio signal is divided into 9 parameter bands. Thus, the horizontal axis indicates the number of time slots and the vertical axis indicates the number of parameter bands. Each of the three parameter sets is applied to a specific time slot. For example, a first parameter set (parameter set 1) is applied to a time slot #1, a second parameter set (parameter set 2) is applied to a time slot #5, and a third parameter set (parameter set 3) is applied to a time slot #9. The parameter sets can be applied to other time slots by interpolating and/or copying the parameter sets to those time slots. Generally, the number of parameter sets can be equal to or less than the number of time slots, and the number of parameter bands can be equal to or less than the number of frequency bands of the audio signal. By encoding spatial information for portions of the time-frequency domain of an audio signal instead of the entire time-frequency domain of the audio signal, it is possible to reduce the amount of spatial information sent from an encoder to a decoder. This data reduction is possible since sparse information in the time-frequency domain is often sufficient for human auditory perception in accordance with known principals of perceptual audio coding.

An important feature of the disclosed embodiments is the encoding and decoding of time slot positions to which parameter sets are applied using a fixed or variable number of bits. The number of parameter bands can also be represented with a fixed number of bits or a variable number of bits. The variable bit coding scheme can also be applied to other information used in spatial audio coding, including but not limited to information associated with time, spatial and/or frequency domains (e.g., applied to a number of frequency subbands output from a filter bank).

FIG. 7A illustrates a syntax for representing configuration information of a spatial information signal according to one embodiment of the present invention. The configuration information includes a plurality of fields 701 to 718 to which a number of bits can be assigned.

A "bsSamplingFrequencyIndex" field 701 indicates a sampling frequency obtained from a sampling process of an audio signal. To represent the sampling frequency, 4 bits are allocated to the "bsSamplingFrequencyIndex" field 701. If a value of the "bsSamplingFrequencyIndex" field 701 is 15, i.e., a binary number of 1111, a "bsSamplingFrequency" field 702 is added to represent the sampling frequency. In this case, 24 bits are allocated to the "bsSamplingFrequency" field 702.

A "bsFrameLength" field 703 indicates a total number of time slots (hereinafter named "numSlots") within one spatial frame, and a relation of numSlots=bsFrameLength+1 can exist between "numSlots" and the "bsFrameLength" field 703.

A "bsFreqRes" field 704 indicates a total number of parameter bands spanning an entire frequency domain of an audio signal. The "bsFreqRes" field 704 will be explained in FIG. 7B.

A "bsTreeConfig" field 705 indicates information for a tree configuration including a plurality of channel converting modules, such as described in reference to FIG. 4. The information for the tree configuration includes such information as a type of a channel converting module, a number of channel converting modules, a type of spatial information used in the channel converting module, a number of input/output channels of an audio signal, etc.

The tree configuration can have one of a 5-1-5 configuration, a 5-2-5 configuration, a 7-2-7 configuration, a 7-5-7 configuration and the like, according to a type of a channel converting module or a number of channels. The 5-2-5 configuration of the tree configuration is shown in FIG. 4.

A "bsQuantMode" field 706 indicates quantization mode information of spatial information.

A "bsOneIcc" field 707 indicates whether one ICC parameter sub-set is used for all OTT boxes. In this case, the parameter sub-set means a parameter set applied to a specific time slot and a specific channel converting module.

A "bsArbitraryDownmix" field 708 indicates a presence or non-presence of an arbitrary downmix gain.

A "bsFixedGainSur" field 709 indicates a gain applied to a surround channel, e.g., LS (left surround) and RS (right surround).

A "bsFixedgainLF" field 710 indicates a gain applied to a LFE channel.

A "bsFixedGainDM" field 711 indicates a gain applied to a downmix signal.

A "bsMatrixMode" field 712 indicates whether a matrix compatible stereo downmix signal is generated from an encoder.

A "bsTempShapeConfig" field 713 indicates an operation mode of temporal shaping (e.g., TES (temporal envelope shaping) and/or TP (temporal shaping)) in a decoder.

"bsDecorrConfig" field 714 indicates an operation mode of a decorrelator of a decoder.

And, "bs3DaudioMode" field 715 indicates whether a downmix signal is encoded into a 3D signal and whether an inverse HRTF processing is used.

After information of each of the fields has been determined/extracted in an encoder/decoder, information for a number of parameter bands applied to a channel converting module is determined/extracted in the encoder/decoder. A number of parameter bands applied to an OTT box is first determined/extracted (716) and a number of parameter bands applied to a TTT box is then determined/extracted (717). The number of parameter bands to the OTT box and/or TTT box will be described in detail with reference to FIGS. 8A to 9B.

In case that an extension frame exists, a "spatialExtensionConfig" block 718 includes configuration information for the extension frame. Information included in the "spatialExtensionConfig" block 718 will be described in reference to FIGS. 10A to 10D.

FIG. 7B is a table for a number of parameter bands of a spatial information signal according to one embodiment of the present invention. A "numBands" indicates a number of parameter bands for an entire frequency domain of an audio signal and "bsFreqRes" indicates index information for the number of parameter bands. For example, the entire frequency domain of an audio signal can be divided by a number of parameter bands as desired (e.g., 4, 5, 7, 10, 14, 20, 28, etc.).

In some embodiments, one parameter can be applied to each parameter band. For example, if the "numBands" is 28, then the entire frequency domain of an audio signal is divided into 28 parameter bands and each of the 28 parameters can be applied to each of the 28 parameter bands. In another example, if the "numBands" is 4, then the entire frequency domain of a given audio signal is divided into 4 parameter bands and each of the 4 parameters can be applied to each of the 4 parameter bands. In FIG. 7B, the term "Reserved" means that a number of parameter bands for the entire frequency domain of a given audio signal is not determined.

It should be noted a human auditory organ is not sensitive to the number of parameter bands used in the coding scheme. Thus, using a small number of parameter bands can provide a similar spatial audio effect to a listener than if a larger number of parameter bands were used.

Unlike the "numBands", the "numSlots" represented by the "bsFramelength" field 703 shown in FIG. 7A can represent all values. The values of "numSlots" may be limited, however, if the number of samples within one spatial frame is exactly divisible by the "numSlots." Thus, if a maximum value of the "numSlots" to be substantially represented is 'b', every value of the "bsFramelength" field 703 can be represented by ceil{$\log_2$(b))} bit(s). In this case, 'ceil(x)' means a minimum integer larger than or equal to the 'x'. For example, if one spatial frame includes 72 time slots, then ceil{$\log_2$(72)} =7 bits can be allocated to the "bsFrameLength" field 703, and the number of parameter bands applied to a channel converting module can be decided within the "numBands".

FIG. 8A illustrates a syntax for representing a number of parameter bands applied to an OTT box by a fixed number of bits according to one embodiment of the present invention. Referring to FIGS. 7A and 8A, a value of 'i' has a value of zero to numOttBoxes−1, where 'numOttBoxes' is the total number of OTT boxes. Namely, the value of 'i' indicates each OTT box, and a number of parameter bands applied to each OTT box is represented according to the value of 'i'. If an OTT box has an LFE channel mode, the number of parameter bands (hereinafter named "bsOttBands") applied to the LFE channel of the OTT box can be represented using a fixed number of bits. In the example shown in FIG. 8A, 5 bits are allocated to the "bsOttBands" field 801. If an OTT box does not have a LFE channel mode, the total number of parameter bands (numBands) can be applied to a channel of the OTT box.

FIG. 8B illustrates a syntax for representing a number of parameter bands applied to an OTT box by a variable number of bits according to one embodiment of the present invention. FIG. 8B, which is similar to FIG. 8A, differs from FIG. 8A in that "bsOttBands" field 802 shown in FIG. 8B is represented by a variable number of bits. In particular, the "bsOttBands" field 802, which has a value equal to or less than "numBands", can be represented by a variable number of bits using "numBands".

If the "numBands" lies within a range equal to or greater than 2^(n−1) and less than 2^(n), the "bsOttBands" field 802 can be represented by variable n bits.

For example: (a) if the "numBands" is 40, the "bsOttBands" field 802 is represented by 6 bits; (b) if the "numBands" is 28 or 20, the "bsOttBands" field 802 is represented by 5 bits; (c) if the "numBands" is 14 or 10, the "bsOttBands" field 802 is represented by 4 bits; and (d) if the "numBands" is 7, 5 or 4, the "bsOttBands" field 802 is represented by 3 bits.

If the "numBands" lies within a range greater than 2^(n−1) and equal to or less than 2^(n), the "bsOttBands" field 802 can be represented by variable n bits.

For example: (a) if the "numBands" is 40, the "bsOttBands" field 802 is represented by 6 bits; (b) if the "numBands" is 28 or 20, the "bsOttBands" field 802 is represented by 5 bits; (c) if the "numBands" is 14 or 10, the "bsOttBands" field 802 is represented by 4 bits; (d) if the "numBands" is 7 or 5, the "bsOttBands" field 802 is represented by 3 bits; and (e) if the "numBands" is 4, the "bsOttBands" field 802 is represented by 2 bits.

The "bsOttBands" field 802 can be represented by a variable number of bits through a function (hereinafter named "ceil function") of rounding up to a nearest integer by taking the "numBands" as a variable.

In particular, i) in case of 0<bsOttBands≦numBands or 0≦bsOttBands<numBands, the "bsOttBands" field 802 is represented by a number of bits corresponding to a value of ceil($\log_2$(numBands)) or ii) in case of 0≦bsOttBands≦numBands, the "bsOttBands" field 802 can be represented by ceil($\log_2$(numBands+1) bits.

If a value equal to or less than the "numBands" (hereinafter named "numberBands") is arbitrarily determined, the "bsOttBands" field 802 can be represented by a variable number of bits through the ceil function by taking the "numberBands" as a variable.

In particular, i) in case of 0<bsOttBands≦numberBands or 0≦bsOttBands<numberBands, the "bsOttBands" field 802 is represented by ceil($\log_2$(numberBands)) bits or ii) in case of 0≦bsOttBands≦numberBands, the "bsOttBands" field 802 can be represented by ceil($\log_2$(numberBands+1) bits.

If more than one OTT box is used, a combination of the "bsOttBands" can be expressed by Formula 1 below $$\sum_{i=1}^{N} numBands^{i-1} \cdot bsOttBands_i,\ 0 \le bsOttBands_i < numBands,$$

where, $bsOttBands_i$ indicates an $i^{th}$ "bsOttBands". For example, assume there are three OTT boxes and three values (N=3) for the "bsOttBands" field 802. In this example, the three values of the "bsOttBands" field 802 (hereinafter named a1, a2 and a3, respectively) applied to the three OTT boxes, respectively, can be represented by 2 bits each. Hence, a total of 6 bits are needed to express the values a1, a2 and a3. Yet, if the values a1, a2 and a3 are represented as a group, then 27 (=3*3*3) cases can occur, which can be represented by 5 bits, saving one bit. If the "numBands" is 3 and a group value represented by 5 bits is 15, the group value can be represented as 15=1x(3^2)+2*(3^1)+0*(3^0). Hence, a decoder can determine from the group value 15 that the three values a1, a2 and a3 of the "bsOttBands" field 802 are 1, 2 and 0, respectively, by applying the inverse of Formula 1.

In the case of multiple OTT boxes, the combination of "bsOttBands" can be represented as one of Formulas 2 to 4 (defined below) using the "numberBands". Since representation of "bsOttBands" using the "numberbands" is similar to the representation using the "numBands" in Formula 1, a detailed explanation shall be omitted and only the formulas are presented below.

$$\sum_{i=1}^{N} (numberBands+1)^{i-1} \cdot bsOttBands_i,\quad 0 \le bsOttBands_i \le numberBands, \qquad \text{[Formula 2]}$$

$$\sum_{i=1}^{N} numberBands^{i-1} \cdot bsOttBands_i,\quad 0 \le bsOttBands_i < numberBands, \qquad \text{[Formula 3]}$$

$$\sum_{i=1}^{N} numberBands^{i-1} \cdot bsOttBands_i,\quad 0 < bsOttBands_i \le numberBands, \qquad \text{[Formula 4]}$$

FIG. 9A illustrates a syntax for representing a number of parameter bands applied to a TTT box by a fixed number of bits according to one embodiment of the present invention. Referring to FIGS. 7A and 9A, a value of 'i' has a value of zero to numTttBoxes−1, where 'numTttBoxes' is a number of all TTT boxes. Namely, the value of 'i' indicates each TTT box. A number of parameter bands applied to each TTT box is represented according to the value of 'i'. In some embodiments, the TTT box can be divided into a low frequency band range and a high frequency band range, and different processes can be applied to the low and high frequency band ranges. Other divisions are possible.

A "bsTttDualMode" field 901 indicates whether a given UTT box operates in different modes (hereinafter called "dual mode") for a low band range and a high band range, respectively. For example, if a value of the "bsTttDualMode" field 901 is zero, then one mode is used for the entire band range without discriminating between a low band range and a high band range. If a value of the "bsTttDualMode" field 901 is 1, then different modes can be used for the low band range and the high band range, respectively.

A "bsTttModeLow" field 902 indicates an operation mode of a given TTT box, which can have various operation modes. For example, the TTT box can have a prediction mode which uses, for example, CPC and ICC parameters, an energy-based mode which uses, for example, CLD parameters, etc. If a TTT box has a dual mode, additional information for a high band range may be needed.

A "bsTttModeHigh" field 903 indicates an operation mode of the high band range, in the case that the TTT box has a dual mode.

A "bsTttBandsLow" field 904 indicates a number of parameter bands applied to the UTw box.

A "bsTttBandsHigh" field 905 has "numBands".

If a TTT box has a dual mode, a low band range may be equal to or greater than zero and less than "bsTttBandsLow", while a high band range may be equal to or greater than "bsTttBandsLow" and less than "bsTttBandsHigh".

If a TTT box does not have a dual mode, a number of parameter bands applied to the TTT box may be equal to or greater than zero and less than "numBands" (907).

The "bsTttBandsLow" field 904 can be represented by a fixed number of bits. For instance, as shown in FIG. 9A, 5 bits can be allocated to represent the "bsTttBandsLow" field 904.

FIG. 9B illustrates a syntax for representing a number of parameter bands applied to a TTT box by a variable number of bits according to one embodiment of the present invention. FIG. 9B is similar to FIG. 9A but differs from FIG. 9A in representing a "bsTttBandsLow" field 907 of FIG. 9B by a variable number of bits while representing a "bsTttBandsLow" field 904 of FIG. 9A by a fixed number of bits. In particular, since the "bsTttBandsLow" field 907 has a value equal to or less than "numBands", the "bsTttBands" field 907 can be represented by a variable number of bits using "numBands".

In particular, in the case that the "numBands" is equal to or greater than 2^(n−1) and less than 2^(n), the "bsTttBandsLow" field 907 can be represented by n bits.

For example: (i) if the "numBands" is 40, the "bsTttBandsLow" field 907 is represented by 6 bits; (ii) if the "numBands" is 28 or 20, the "bsTttBandsLow" field 907 is represented by 5 bits; (iii) if the "numBands" is 14 or 10, the "bsTttBandsLow" field 907 is represented by 4 bits; and (iv) if the "numBands" is 7, 5 or 4, the "bsTttBandsLow" field 907 is represented by 3 bits.

If the "numBands" lies within a range greater than 2^(n−1) and equal to or less than 2^(n), then the "bsTttBandsLow" field 907 can be represented by n bits.

For example: (i) if the "numBands" is 40, the "bsTttBandsLow" field 907 is represented by 6 bits; (ii) if the "numBands" is 28 or 20, the "bsTttBandsLow" field 907 is represented by 5 bits; (iii) if the "numBands" is 14 or 10, the "bsTttBandsLow" field 907 is represented by 4 bits; (iv) if the "numBands" is 7 or 5, the "bsTttBandsLow" field 907 is represented by 3 bits; and (v) if the "numBands" is 4, the "bsTttBandsLow" field 907 is represented by 2 bits.

The "bsTttBandsLow" field 907 can be represented by a number of bits decided by a ceil function by taking the "numBands" as a variable.

For example: i) in case of 0<bsTttBandsLow≦numBands or 0≦bsTttBandsLow<numBands, the "bsTttBandsLow" field 907 is represented by a number of bits corresponding to a value of ceil($\log_2$(numBands)) or ii) in case of 0≦bsTttBandsLow≦numBands, the "bsTttBandsLow" field 907 can be represented by ceil($\log_2$(numBands+1) bits.

If a value equal to or less than the "numBands", i.e., "numberBands" is arbitrarily determined, the "bsTttBandsLow" field 907 can be represented by a variable number of bits using the "numberBands".

In particular, i) in case of 0<bsTttBandsLow≦numberBands or 0≦bsTttBandsLow<numberBands, the "bsTttBandsLow" field 907 is represented by a number of bits corresponding to a value of ceil($\log_2$(numberBands)) or ii) in case of 0≦bsTttBandsLow≦numberBands, the "bsTttBandsLow" field 907 can be represented by a number of bits corresponding to a value of ceil($\log_2$(numberBands+1).

If the case of multiple TTT boxes, a combination of the "bsTttBandsLow" can be expressed as Formula 5 defined below.

$$\sum_{i=1}^{N} numBands^{i-1} \cdot bsTttBandsLow_i, \quad 0 \le bsTttBandsLow_i < numBands, \qquad \text{[Formula 5]}$$

In this case, $bsTttBandsLow_i$ indicates an $i^{th}$ "bsTttBandsLow". Since the meaning of Formula 5 is identical to that of Formula 1, a detailed explanation of Formula 5 is omitted in the following description.

In the case of multiple TTT boxes, the combination of "bsTttBandsLow" can be represented as one of Formulas 6 to 8 using the "numberBands". Since the meaning of Formulas 6 to 8 is identical to those of Formulas 2 to 4, a detailed explanation of Formulas 6 to 8 will be omitted in the following description.

$$\sum_{i=1}^{N} (numberBands+1)^{i-1} \cdot bsTttBandsLow_i, \quad 0 \le bsTttBandsLow_i \le numberBands, \qquad \text{[Formula 6]}$$

$$\sum_{i=1}^{N} numberBands^{i-1} \cdot bsTttBandsLow_i, \quad 0 \le bsTttBandsLow_i < numberBands, \qquad \text{[Formula 7]}$$

$$\sum_{i=1}^{N} numberBands^{i-1} \cdot bsTttBandsLow_i, \quad 0 < bsTttBandsLow_i \le numberBands, \qquad \text{[Formula 8]}$$

A number of parameter bands applied to the channel converting module (e.g., OTT box and/or TTT box) can be represented as a division value of the "numBands". In this case, the division value uses a half value of the "numBands" or a value resulting from dividing the "numBands" by a specific value.

Once a number of parameter bands applied to the OTT and/or TTT box is determined, parameter sets can be determined which can be applied to each OTT box and/or each TTT box within a range of the number of parameter bands. Each of the parameter sets can be applied to each OTT box and/or each TTT box by time slot unit. Namely, one parameter set can be applied to one time slot.

As mentioned in the foregoing description, one spatial frame can include a plurality of time slots. If the spatial frame is a fixed frame type, then a parameter set can be applied to a plurality of the time slots with an equal interval. If the frame is a variable frame type, position information of the time slot to which the parameter set is applied is needed. This will be explained in detail later with reference to FIGS. 13A to 13C.

FIG. 10A illustrates a syntax for spatial extension configuration information for a spatial extension frame according to one embodiment of the present invention. Spatial extension configuration information can include a "bsSacExtType" field 1001, a "bsSacExtLen" field 1002, a "bsSacExtLenAdd" field 1003, a "bsSacExtLenAddAdd" field 1004 and a "bsFillBits" field 1007. Other fields are possible.

The "bsSacExtType" field 1001 indicates a data type of a spatial extension frame. For example, the spatial extension frame can be filled up with zeros, residual signal data, arbitrary downmix residual signal data or arbitrary tree data.

The "bsSacExtLen" field 1002 indicates a number of bytes of the spatial extension configuration information.

The "bsSacExtLenAdd" field 1003 indicates an additional number of bytes of spatial extension configuration information if a byte number of the spatial extension configuration information becomes equal to or greater than, for example, 15.

The "bsSacExtLenAddAdd" field 1004 indicates an additional number of bytes of spatial extension configuration information if a byte number of the spatial extension configuration information becomes equal to or greater than, for example, 270.

After the respective fields have been determined or extracted in an encoder or decoder, the configuration information for a data type included in the spatial extension frame is determined (1005).

As mentioned in the foregoing description, residual signal data, arbitrary downmix residual signal data, tree configuration data or the like can be included in the spatial extension frame.

Subsequently, a number of unused bits of a length of the spatial extension configuration information is calculated 1006.

The "bsFillBits" field 1007 indicates a number of bits of data that can be neglected to fill the unused bits.

FIGS. 10B and 10C illustrate syntaxes for spatial extension configuration information for a residual signal in case that the residual signal is included in a spatial extension frame according to one embodiment of the present invention.

Referring to FIG. 10B, a "bsResidualSamplingFrequencyIndex" field 1008 indicates a sampling frequency of a residual signal.

A "bsResidualFramesPerSpatialFrame" field 1009 indicates a number of residual frames per a spatial frame. For instance, 1, 2, 3 or 4 residual frames can be included in one spatial frame.

A "ResidualConfig" block 1010 indicates a number of parameter bands for a residual signal applied to each OTT and/or TTT box.

Referring to FIG. 10C, a "bsResidualPresent" field 1011 indicates whether a residual signal is applied to each OTT and/or TTT box.

A "bsResidualBands" field 1012 indicates a number of parameter bands of the residual signal existing in each OTT and/or TTT box if the residual signal exists in the each OTT and/or TTT box. A number of parameter bands of the residual signal can be represented by a fixed number of bits or a variable number of bits. In case that the number of parameter bands is represented by a fixed number of bits, the residual signal is able to have a value equal to or less than a total number of parameter bands of an audio signal. So, a bit number (e.g., 5 bits in FIG. 10C) necessary for representing a number of all parameter bands can be allocated.

FIG. 10D illustrates a syntax for representing a number of parameter bands of a residual signal by a variable number of bits according to one embodiment of the present invention. A "bsResidualBands" field 1014 can be represented by a variable number of bits using "numBands". If the numBands is equal to or greater than 2^(n−1) and less than 2^(n), the "bsResidualBands" field 1014 can be represented by n bits.

For instance: (i) if the "numBands" is 40, the "bsResidualBands" field 1014 is represented by 6 bits; (ii) if the "numBands" is 28 or 20, the "bsResidualBands" field 1014 is represented by 5 bits; (iii) if the "numBands" is 14 or 10, the "bsResidualBands" field 1014 is represented by 4 bits; and (iv) if the "numBands" is 7, 5 or 4, the "bsResidualBands" field 1014 is represented by 3 bits.

If the numBands is greater than 2^(n−1) and equal to or less than 2^(n), then the number of parameter bands of the residual signal can be represented by n bits.

For instance: (i) if the "numBands" is 40, the "bsResidualBands" field 1014 is represented by 6 bits; (ii) if the "numBands" is 28 or 20, the "bsResidualBands" field 1014 is represented by 5 bits; (iii) if the "numBands" is 14 or 10, the "bsResidualBands" field 1014 is represented by 4 bits; (iv) if the "numBands" is 7 or 5, the "bsResidualBands" field 1014 is represented by 3 bits; and (v) if the "numBands" is 4, the "bsResidualBands" field 1014 is represented by 2 bits.

Moreover, the "bsResidualBands" field 1014 can be represented by a bit number decided by a ceil function of rounding up to a nearest integer by taking the "numBands" as a variable.

In particular, i) in case of 0<bsResidualBands≦numBands or 0≦bsResidualBands<numBands, the "bsResidualBands" field 1014 is represented by ceil{$\log_2$(numBands)} bits or ii) in case of 0≦bsResidualBands≦numBands, the "bsResidualBands" field 1014 can be represented by ceil{$\log_2$(numBands+1)} bits.

In some embodiments, the "bsResidualBands" field 1014 can be represented using a value (numberBands) equal to or less than the numBands.

In particular, i) in case of 0<bsresidualBands≦numberBands or 0≦bsresidualBands<numberBands, the "bsResidualBands" field 1014 is represented by ceil{$\log_2$(numberBands)} bits or ii) in case of 0≦bsresidualBands≦numberBands, the "bsResidualBands" field 1014 can be represented by-ceil{$\log_2$(numberBands+1)} bits.

If a plurality of residual signals (N) exist, a combination of the "bsResidualBands" can be expressed as shown in Formula 9 below.

$$\sum_{i=1}^{N} numBands^{i-1} \cdot bsResidualBands_i, \quad 0 \le bsResidualBands_i < numBands, \qquad \text{[Formula 9]}$$

In this case, $bsResidualBands_i$ indicates an $i^{th}$ "bsresidualBands". Since a meaning of Formula 9 is identical to that of Formula 1, a detailed explanation of Formula 9 is omitted in the following description.

If there are multiple residual signals, a combination of the "bsresidualBands" can be represented as one of Formulas 10 to 12 using the "numberBands". Since representation of "bsresidualBands" using the "numberbands" is identical to the representation of Formulas 2 to 4, its detailed explanation shall be omitted in the following description.

$$\sum_{i=1}^{N} (numberBands + 1)^{i-1} \cdot bsResidualBands_i, \quad 0 \le bsResidualBands_i \le numberBands, \qquad \text{[Formula 10]}$$

$$\sum_{i=1}^{N} numberBands^{i-1} \cdot bsResidualBands_i, \quad 0 \le bsResidualBands_i < numberBands, \qquad \text{[Formula 11]}$$

$$\sum_{i=1}^{N} numberBands^{i-1} \cdot bsResidualBands_i, \quad 0 < bsResidualBands_i \le numberBands, \qquad \text{[Formula 12]}$$

A number of parameter bands of the residual signal can be represented as a division value of the "numBands". In this case, the division value is able to use a half value of the "numBands" or a value resulting from dividing the "numBands" by a specific value.

The residual signal may be included in a bitstream of an audio signal together with a downmix signal and a spatial information signal, and the bitstream can be transferred to a decoder. The decoder can extract the downmix signal, the spatial information signal and the residual signal from the bitstream.

Subsequently, the downmix signal is upmixed using the spatial information. Meanwhile, the residual signal is applied to the downmix signal in the course of upmixing. In particular, the downmix signal is upmixed in a plurality of channel converting modules using the spatial information. In doing so, the residual signal is applied to the channel converting module. As mentioned in the foregoing description, the channel converting module has a number of parameter bands and a parameter set is applied to the channel converting module by a time slot unit. When the residual signal is applied to the channel converting module, the residual signal may be needed to update inter-channel correlation information of the audio signal to which the residual signal is applied. Then, the updated inter-channel correlation information is used in an up-mixing process.

Figure 11A:
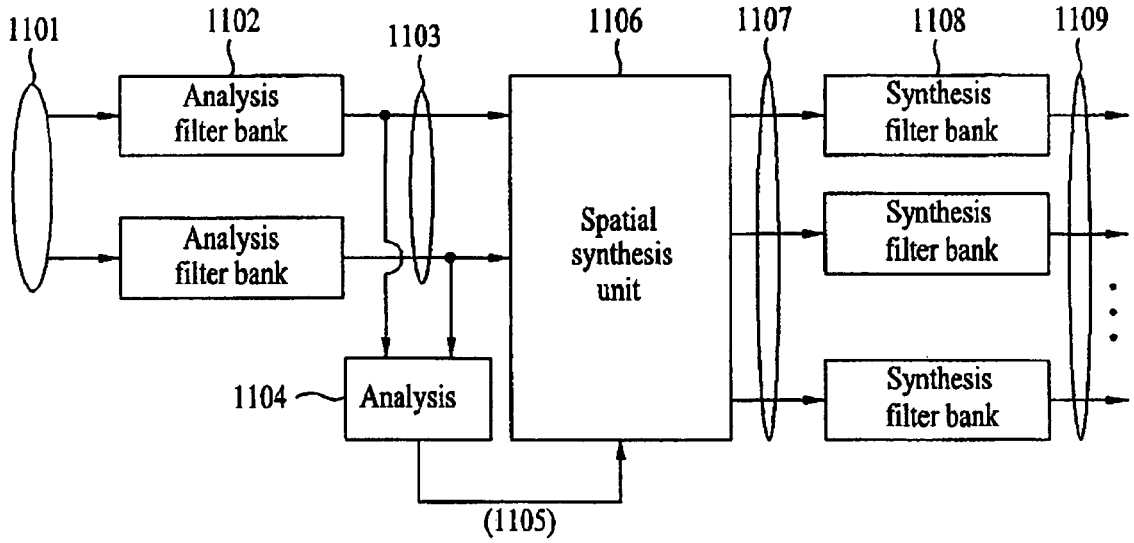
FIG. 11A is a block diagram of a decoding apparatus in using non-guided coding according to one embodiment of the present invention.

FIG. 11A is a block diagram of a decoder for non-guided coding according to one embodiment of the present invention. Non-guided coding means that spatial information is not included in a bitstream of an audio signal.

In some embodiments, the decoder includes an analysis filterbank 1102, an analysis unit 1104, a spatial synthesis unit 1106 and a synthesis filterbank 1108. Although a downmix signal in a stereo signal type is shown in FIG. 11A, other types of downmix signals can be used.

In operation, the decoder receives a downmix signal 1101 and the analysis filterbank 1102 converts the received downmix signal 1101 to a frequency domain signal 1103. The analysis unit 1104 generates spatial information from the converted downmix signal 1103. The analysis unit 1104 performs a processing by a slot unit and the spatial information 1105 can be generated per a plurality of slots. In this case, the slot includes a time slot.

The spatial information can be generated in two steps. First, a downmix parameter is generated from the downmix signal. Second, the downmix parameter is converted to spatial information, such as a spatial parameter. In some embodiments, the downmix parameter can be generated through a matrix calculation of the downmix signal.

The spatial synthesis unit 1106 generates a multi-channel audio signal 1107 by synthesizing the generated spatial information 1105 with the downmix signal 1103. The generated multi-channel audio signal 1107 passes through the synthesis filterbank 1108 to be converted to a time domain audio signal 1109.

The spatial information may be generated at predetermined slot positions. The distance between the positions may be equal (i.e., equidistant). For example, the spatial information may be generated per 4 slots. The spatial information may be also generated at variable slot positions. In this case, the slot position information from which the spatial information is generated can be extracted from the bitstream. The position information can be represented by a variable number of bits. The position information can be represented as a absolute value and a difference value from a previous slot position information.

In case of using the non-guided coding, a number of parameter bands (hereinafter named "bsNumguidedBlindBands") for each channel of an audio signal can be represented by a fixed number of bits. The "bsNumguidedBlindBands" can be represented by a variable number of bits using "numBands". For example, if the "numBands" is equal to or greater than 2^(n−1) and less than 2^(n), the "bsNumguidedBlindBands" can be represented by variable n bits.

In particular, (a) if the "numBands" is 40, the "bsNumguidedBlindBands" is represented by 6 bits, (b) if the "numBands" is 28 or 20, the "bsNumguidedBlindBands" is represented by 5 bits, (c) if the "numBands" is 14 or 10, the "bsNumguidedBlindBands" is represented by 4 bits, and (d) if the "numBands" is 7, 5 or 4, the "bsNumguidedBlindBands" is represented by 3 bits.

If the "numBands" is greater than 2^(n−1) and equal to or less than 2^(n), then "bsNumguidedBlindBands" can be represented by variable n bits.

For instance: (a) if the "numBands" is 40, the "bsNumguidedBlindBands" is represented by 6 bits; (b) if the "numBands" is 28 or 20, the "bsNumguidedBlindBands" is represented by 5 bits; (c) if the "numBands" is 14 or 10, the "bsNumguidedBlindBands" is represented by 4 bits; (d) if the "numBands" is 7 or 5, the "bsNumguidedBlindBands" is represented by 3 bits; and (e) if the "numBands" is 4, the "bsNumguidedBlindBands" is represented by 2 bits.

Moreover, "bsNumguidedBlindBands" can be represented by a variable number of bits using the ceil function by taking the "numBands" as a variable.

For example, i) in case of 0<bsNumguidedBlindBands≦numBands or 0≦bsNumguidedBlindBands<numBands, the "bsNumguidedBlindBands" is represented by ceil{$\log_2$(numBands)} bits or ii) in case of 0≦bsNumguidedBlindBands≦numBands, the "bsNumguidedBlindBands" can be represented by ceil{$\log_2$(numBands+1)} bits.

If a value equal to or less than the "numBands", i.e., "numberBands" is arbitrarily determined, the "bsNumguidedBlindBands" can be represented as follows.

In particular, i) in case of 0<bsNumguidedBlindBands≦numberBands or 0≦bsNumguidedBlindBands<numberBands, the "bsNumguidedBlindBands" is represented by ceil{$\log_2$(numberBands)} bits or ii) in case of 0≦sbsNumguidedBlindBands≦numberBands, the "bsNumguidedBlindBands" can be represented by ceil{$\log_2$(numberBands+1)} bits.

If a number of channels (N) exist, a combination of the "bsNumguidedBlindBands" can be expressed as Formula 13.

$$\sum_{i=1}^{N} numBands^{i-1} \cdot bsNumGuidedBlindBands_i, \quad 0 \le bsNumGuidedBlindBands_i < numBands, \qquad \text{[Formula 13]}$$

In this case, "bsNumguidedBlindBands$_i$" indicates an $i^{th}$ "bsNumguidedBlindBands". Since the meaning of Formula 13 is identical to that of Formula 1, a detailed explanation of Formula 13 is omitted in the following description.

If there are multiple channels, the "bsNumguidedBlindBands" can be represented as one of Formulas 14 to 16 using the "numberBands". Since representation of "bsNumguidedBlindBands" using the "numberbands" is identical to the representations of Formulas 2 to 4, detailed explanation of Formulas 14 to 16 will be omitted in the following description.

$$\sum_{i=1}^{N} (numberBands + 1)^{i-1} \cdot bsNumGuidedBlindBands_i, \quad 0 \le bsNumGuidedBlindBands_i \le numberBands, \qquad \text{[Formula 14]}$$

$$\sum_{i=1}^{N} numberBands^{i-1} \cdot bsNumGuidedBlindBands_i, \quad 0 \le bsNumGuidedBlindBands_i < numberBands, \qquad \text{[Formula 15]}$$

$$\sum_{i=1}^{N} numberBands^{i-1} \cdot bsNumGuidedBlindBands_i, \quad 0 < bsNumGuidedBlindBands_i \le numberBands, \qquad \text{[Formula 16]}$$

Figure 11B:
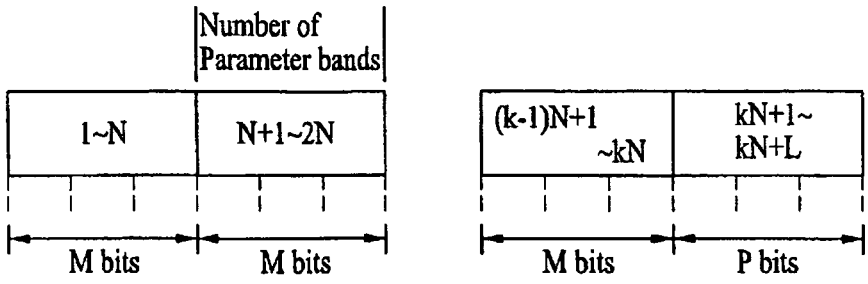
FIG. 11B is a diagram for a method of representing a number of parameter bands as a group according to one embodiment of the present invention.

FIG. 11B is a diagram for a method of representing a number of parameter bands as a group according to one embodiment of the present invention. A number of parameter bands includes number information of parameter bands applied to a channel converting module, number information of parameter bands applied to a residual signal and number information of parameter bands for each channel of an audio signal in case of using non-guided coding. In the case that there exists a plurality of number information of parameter bands, the plurality of the number information (e.g., "bsOttBands", "bsTttBands", "bsResidualBand" and/or "bsNumguidedBlindBands") can be represented as at least one or more groups.

Referring to FIG. 11B, if there are (kN+L) number information of parameter bands and if Q bits are needed to represent each number information of parameter bands, a plurality of number information of parameter bands can be represented as a following group. In this case, 'k' and 'N' are arbitrary integers not zero and 'L' is an arbitrary integer meeting 0≦L<N.

A grouping method includes the steps of generating k groups by binding N number information of parameter bands and generating a last group by binding last L number information of parameter bands. The k groups can be represented as M bits and the last group can be represented as p bits. In this case, the M bits are preferably less than N*Q bits used in the case of representing each number information of parameter bands without grouping them. The p bits are preferably equal to or less than L*Q bits used in case of representing each number information of the parameter bands without grouping them.

For instance, assume that two number information of parameter bands are b1 and b2, respectively. If each of the b1 and b2 is able to have five values, 3 bits are needed to represent each of the b1 and b2. In this case, even if the 3 bits are able to represent eight values, five values are substantially needed. So, each of the b1 and b2 has three redundancies. Yet, in case of representing the b1 and b2 as a group by binding the b1 and b2 together, 5 bits may be used instead of 6 bits (=3 bits+3 bits). In particular, since all combinations of the b1 and b2 include 25 (=5*5) types, a group of the b1 and b2 can be represented as 5 bits. Since the 5 bits are able to represent 32 values, seven redundancies are generated in case of the grouping representation. Yet, in case of a representation by grouping b1 and b2, redundancy is less than that of a case of representing each of the b1 and b2 as 3 bits. A method of representing a plurality of number information of parameter bands as groups can be implemented in various ways as follows.

If a plurality of number information of parameter bands have 40 kinds of values each, k groups are generated using 2, 3, 4, 5 or 6 as the N. The k groups can be represented as 11, 16, 22, 27 and 32 bits, respectively. Alternatively, the k groups are represented by combining the respective cases.

If a plurality of number information of parameter bands have 28 kinds of values each, k groups are generated using 6 as the N, and the k groups can be represented as 29 bits.

If a plurality of number information of parameter bands have 20 kinds of values each, k groups are generated using 2, 3, 4, 5, 6 or 7 as the N. The k groups can be represented as 9, 13, 18, 22, 26 and 31 bits, respectively. Alternatively, the k groups can be represented by combining the respective cases.

If a plurality of number information of parameter bands have 14 kinds of values each, k groups can be generated using 6 as the N. The k groups can be represented as 23 bits.

If a plurality of number information of parameter bands have 10 kinds of values each, k groups are generated using 2, 3, 4, 5, 6, 7, 8 or 9 as the N. The k groups can be represented as 7, 10, 14, 17, 20, 24, 27 and 30 bits, respectively. Alternatively, the k groups can be represented by combining the respective cases.

If a plurality of number information of parameter bands have 7 kinds of values each, k groups are generated using 6, 7, 8, 9, 10 or 11 as the N. The k groups are represented as 17, 20, 23, 26, 29 and 31 bits, respectively. Alternatively, the k groups are represented by combining the respective cases.

If a plurality of number information of parameter bands have, for example, 5 kinds of values each, k groups can be generated using 2, 3, 4, 5, 6, 7, 8, 9, 10, 11, 12 or 13 as the N. The k groups can be represented as 5, 7, 10, 12, 14, 17, 19, 21, 24, 26, 28 and 31 bits, respectively. Alternatively, the k groups are represented by combining the respective cases.

Moreover, a plurality of number information of parameter bands can be configured to be represented as the groups described above, or to be consecutively represented by making each number information of parameter bands into an independent bit sequence.

FIG. 12 illustrates syntax representing configuration information of a spatial frame according to one embodiment of the present invention. A spatial frame includes a "FramingInfo" block 1201, a "bsIndependencyfield 1202, a "OttData" block 1203, a "TttData" block 1204, a "SmgData" block 1205 and a "tempShapeData" block 1206.

The "FramingInfo" block 1201 includes information for a number of parameter sets and information for time slot to which each parameter set is applied. The "FramingInfo" block 1201 is explained in detail in FIG. 13A.

The "bsIndependencyFlag" field 1202 indicates whether a current frame can be decoded without knowledge for a previous frame.

The "OttData" block 1203 includes all spatial parameter information for all OTT boxes.

The "TttData" block 1204 includes all spatial parameter information for all TTT boxes.

The "SmgData" block 1205 includes information for temporal smoothing applied to a de-quantized spatial parameter.

The "TempShapeData" block 1206 includes information for temporal envelope shaping applied to a decorrelated signal.

FIG. 13A illustrates a syntax for representing time slot position information, to which a parameter set is applied, according to one embodiment of the present invention. A "bsFramingType" field 1301 indicates whether a spatial frame of an audio signal is a fixed frame type or a variable frame type. A fixed frame means a frame that a parameter set is applied to a preset time slot. For example, a parameter set is applied to a time slot preset with an equal interval. The variable frame means a frame that separately receives position information of a time slot to which a parameter set is applied.

A "bsNumParamSets" field 1302 indicates a number of parameter sets within one spatial frame (hereinafter named "numParamSets"), and a relation of "numParamSets=bsNumparamSets+1" exists between the "numParamSets" and the "bsNumParamSets".

Since, e.g., 3 bits are allocated to the "bsNumParamSets" field 1302 in FIG. 13A, a maximum of eight parameter sets can be provided within one spatial frame. Since there is no limit on the number of allocated bits more parameter sets can be provided within a spatial frame.

If the spatial frame is a fixed frame type, position information of a time slot to which a parameter set is applied can be decided according to a preset rule, and additional position information of a time slot to which a parameter set is applied is unnecessary. However, if the spatial frame is a variable frame type, position information of a time slot to which a parameter set is applied is needed.

A "bsParamSlot" field 1303 indicates position information of a time slot to which a parameter set is applied. The "bsParamSlot" field 1303 can be represented by a variable number of bits using the number of time slots within one spatial frame, i.e., "numSlots". In particular, in case that the "numSlots" is equal to or greater than 2^(n−1) and less than 2^(n), the "bsParamSlot" field 1103 can be represented by n bits.

For instance: (i) if the "numSlots" lies within a range between 64 and 127, the "bsParamSlot" field 1303 can be represented by 7 bits; (ii) if the "nuniSlots" lies within a range between 32 and 63, the "bsParamSlot" field 1303 can be represented by 6 bits; (iii) if the "numSlots" lies within a range between 16 and 31, the "bsParamSlot" field 1303 can be represented by 5 bits; (iv) if the "numSlots" lies within a range between 8 and 15, the "bsParamSlot" field 1303 can be represented by 4 bits; (v) if the "numSlots" lies within a range between 4 and 7, the "bsParamSlot" field 1303 can be represented by 3 bits; (vi) if the "numSlots" lies within a range between 2 and 3, the "bsParamSlot" field 1303 can be represented by 2 bits; (vii) if the "numSlots" is 1, the "bsParamSlot" field 1303 can be represented by 1 bit; and (viii) if the "numSlots" is 0, the "bsParamSlot" field 1303 can be represented by 0 bit. Likewise, if the "numSlots" lies within a range between 64 and 127, the "bsParamSlot" field 1303 can be represented by 7 bits.

If there are multiple parameter sets (N), a combination of the "bsParamSlot" can be represented according to Formula 9.

$$\sum_{i=1}^{N} numSlots^{i-1} \cdot bsParamSlot_i,\ 0 \le bsParamSlot_i < numSlots, \quad \text{[Formula 9]}$$

In this case, "bsParamSlotsi" indicates a time slot to which an $i^{th}$ parameter set is applied. For instance, assume that the "numSlots" is 3 and that the "bsPararnSlot" field 1303 can have ten values. In this case, three information (hereinafter named c1, c2 and c3, respectively) for the "bsParamSlot" field 1303 are needed. Since 4 bits are needed to represent each of the c1, c2 and c3, total 12 (=4*3) bits are needed. In case of representing the c1, c2 and c3 as a group by binding them together, 1,000 (=10*10*10) cases can occur, which can be represented as 10 bits, thus saving 2 bits. If the "numSlots" is 3 and if the value read as 5 bits is 31, the value can be represented as 31=1×(3^2)+5*(3^1)+7*(3^0). A decoder apparatus can determine that the c1, c2 and c3 are 1, 5 and 7, respectively, by applying the inverse of Formula 9.

FIG. 13B illustrates a syntax for representing position information of a time slot to which a parameter set is applied as an absolute value and a difference value according to one embodiment of the present invention. If a spatial frame is a variable frame type, the "bsParamSlot" field 1303 in FIG. 13A can be represented as an absolute value and a difference value using a fact that "bsParamSlot" information increases monotonously.

For instance: (i) a position of a time slot to which a first parameter set is applied can be generated into an absolute value, i.e., "bsParamSlot[0]"; and (ii) a position of a time slot to which a second or higher parameter set is applied can be generated as a difference value, i.e., "difference value" between "bsParamSlot[ps]" and "bsParamslot[ps−1]" or "difference value−1" (hereinafter named "bsDiffParamSlot [ps]"). In this case, "ps" means a parameter set.

The "bsParamSlot[0]" field 1304 can be represented by a number of bits (hereinafter named "nBitsParamSlot(0)") calculated using the "numSlots" and the "numParainSets".

The "bsDiffParamSlot[ps]" field 1305 can be represented by a number of bits (hereinafter named "nBitParamSlot(ps)") calculated using the "numSlots", the "numParamSets" and a position of a time slot to which a previous parameter set is applied, i.e., "bsParamSlot[ps−1]".

In particular, to represent "bsParamSlot[ps]" by a minimum number of bits, a number of bits to represent the "bsParamSlot[ps]" can be decided based on the following rules: (i) a plurality of the "bsParamSlot[ps]" increase in an ascending series (bsParamSlot[ps]>bsParamSlot[ps−1]); (ii) a maximum value of the "bsParamSlot[0]" is "numSlots−NumParamSets"; and (iii) in case of 0<ps<numParamSets, "bsParamSlot[ps]" can have a value between "bsParamSlot[ps−1 ]+1" and "numSlots−numParamSets+ps" only.

For example, if the "numSlots" is 10 and if the "numParamSets" is 3, since the "bsParamSlot[ps]" increases in an ascending series, a maximum value of the "bsParamSlot[0]" becomes "10−3=7". Namely, the "bsParamSlot[0]" should be selected from values of 1 to 7. This is because a number of time slots for the rest of parameter sets (e.g., if ps is 1 or 2) is insufficient if the "bsParamSlot[0]" has a value greater than 7.

If "bsParamSlot[0]" is 5, a time slot position bsParamSlot [1] for a second parameter set should be selected from values between "5+1=6" and "10−3+1=8".

If "bsParamSlot[1]" is 7, "bsParamSlot[2]" can become 8 or 9. If "bsParamSlot[1]" is 8, "bsParamSlot[2]" can become 9.

Hence, the "bsParamSlot[ps]" can be represented as a variable bit number using the above features instead of being represented as fixed bits.

In configuring the "bsParamSlot[ps]" in a bitstream, if the "ps" is 0, the "bsParamSlot[0]" can be represented as an absolute value by a number of bits corresponding to "nBitsParamSlot(0)". If the "ps" is greater than 0, the "bsParamSlot[ps]" can be represented as a difference value by a number of bits corresponding to "nBitsParamSlot(ps)". In reading the above-configured "bsParamSlot[ps]" from a bitstream, a length of a bitstream for each data, i.e., "nBitsParamSlot[ps]" can be found using Formula 10.

$$f_b(x) = \begin{cases} 0\text{ bit}, & \text{if } x = 1, \\ 1\text{ bit}, & \text{if } x = 2, \\ 2\text{ bits}, & \text{if } 3 \le x \le 4, \\ 3\text{ bits}, & \text{if } 5 \le x \le 8, \\ 4\text{ bits}, & \text{if } 9 \le x \le 16, \\ 5\text{ bits}, & \text{if } 17 \le x \le 32, \\ 6\text{ bits}, & \text{if } 33 \le x \le 64, \end{cases} \quad \text{[Formula 10]}$$

In particular, the "nBitsParamSlot[ps]" can be found as nBitsParamSlot[0]=$f_b$(numSlots−numParamSets+1). If 0<ps<numParamSets, the "nBitsParamSlot[ps]" can be found as nBitsParamSlot[ps]=$f_b$(numSlots−numParamSets+ps−bsParamnSlot[ps−1]). The "nBitsParamSlot[ps]" can be determined using Formula 11, which extends Formula 10 up to 7 bits.

$$f_b(x) = \begin{cases} 0\text{ bit}, & \text{if } x = 1, \\ 1\text{ bit}, & \text{if } x = 2, \\ 2\text{ bits}, & \text{if } 3 \le x \le 4, \\ 3\text{ bits}, & \text{if } 5 \le x \le 8, \\ 4\text{ bits}, & \text{if } 9 \le x \le 16, \\ 5\text{ bits}, & \text{if } 17 \le x \le 32, \\ 6\text{ bits}, & \text{if } 33 \le x \le 64, \\ 7\text{ bits}, & \text{if } 65 \le x \le 128, \end{cases} \quad \text{[Formula 11]}$$

An example of the function $f_b$(x) is explained as follows. If "numSlots" is 15 and if "numParamSets" is 3, the function can be evaluated as nBitsParamSlot[0]=$f_b$(15−3+1)=4bits.

If the "bsParamSlot[0]" represented by 4 bits is 7, the function can be evaluated as nBitsParamSlot[1]=$f_b$(15−3+1−7)=3bits. In this case, "bsDiffParamSlot[1]" field 1305 can be represented by 3 bits.

If the value represented by the 3 bits is 3, "bsParamSlot[1]" becomes 7+3=10. Hence, it becomes nBitsParamSlot[2]=fb (15−3+2−10)=2bits. In this case, "bsDiffParamSlot[2]" field 1305 can be represented by 2 bits. If the number of remaining time slots is equal to a number of a remaining parameter sets, 0 bits may be allocated to the "bsDiffParamSlot[ps]" field. In other words, no additional information is needed to represent the position of the time slot to which the parameter set is applied.

Thus, a number of bits for "bsParamSlot[ps]" can be variably decided. The number of bits for "bsParamSlot[ps]" can be read from a bitstream using the function $f_b$(x) in a decoder. In some embodiments, the function $f_b$(x) can include the function ceil($\log_2$(x)).

In reading information for "bsParamSlot[ps]" represented as the absolute value and the difference value from a bitstream in a decoder, first the "bsParamSlot[0]" may be read from the bitstream and then the. "bsDiffParamSlot[ps]" may be read for 0<ps<numnParamSets. The "bsParamSlot[ps]" can then be found for an interval 0≦ps<nunParamSets using the "bsParamSlot[0]" and the "bsDiffParamSlot[ps]". For example, as shown in FIG. 13B, a "bsParamSlot[ps]" can be found by adding a "bsParamSlot[ps−1]" to a "bsDiffParamSlot[ps]+1".

Figure 13C:
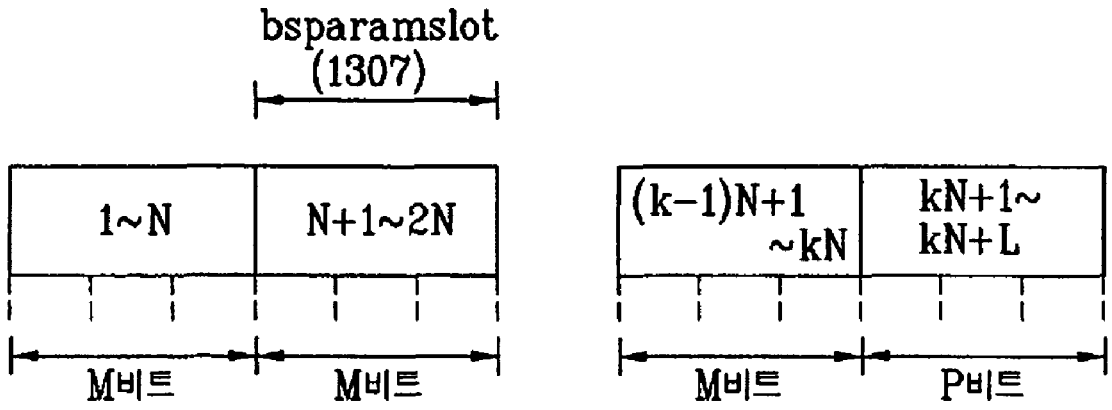
FIG. 13C is a diagram for representing a plurality of position information of time slots to which parameter sets are applied as a group according to one embodiment of the present invention.

FIG. 13C illustrates a syntax for representing position information of a time slot to which a parameter set is applied as a group according to one embodiment of the present invention. In case that a plurality of parameter sets exist, a plurality of "bsParamSlots" 1307 for a plurality of the parameter sets can be represented as at least one or more groups.

If a number of the "bsParamSlots" 1307 is (kN+L) and if Q bits are needed to represent each of the "bsParamSlots" 1307, the "bsParamSlots" 1307 can be represented as a following group. In this case, 'k' and 'N' are arbitrary integers not zero and 'L' is an arbitrary integer meeting 0≦L<N.

A grouping method can include the steps of generating k groups by binding N "bsParamSlots" 1307 each and generating a last group by binding last L "bsParamSlots" 1307. The k groups can be represented by M bits and the last group can be represented by p bits. In this case, the M bits are preferably less than N*Q bits used in the case of representing each of the "bsParamSlots" 1307 without grouping them. The p bits are preferably equal to or less than L*Q bits used in the case of representing each of the "bsParamSlots" 1307 without grouping them.

For example, assume that a pair of "bsParamSlots" 1307 for two parameter sets are d1 and d2, respectively. If each of the d1 and d2 is able to have five values, 3 bits are needed to represent each of the d1 and d2. In this case, even if the 3 bits are able to represent eight values, five values are substantially needed. So, each of the d1 and d2 has three redundancies. Yet, in case of representing the d1 and d2 as a group by binding the d1 and d2 together, 5 bits are used instead of using 6 bits (=3 bits+3 bits). In particular, since all combinations of the d1 and d2 include 25(=5*5) types, a group of the d1 and d2 can be represented as 5 bits only. Since the 5 bits are able to represent 32 values, seven redundancies are generated in case of the grouping representation. Yet, in case of a representation by grouping the d1 and d2, redundancy is smaller than that of a case of representing each of the d1 and d2 as 3 bits.

In configuring the group, data for the group can be configured using "bsParamSlot[0]" for an initial value and a difference value between pairs of the "bsParamSlot[ps]" for a second or higher value.

In configuring the group, bits can be directly allocated without grouping if a number of parameter set is 1 and bits can be allocated after completion of grouping if a number of parameter sets is equal to or greater than 2.

Figure 14:
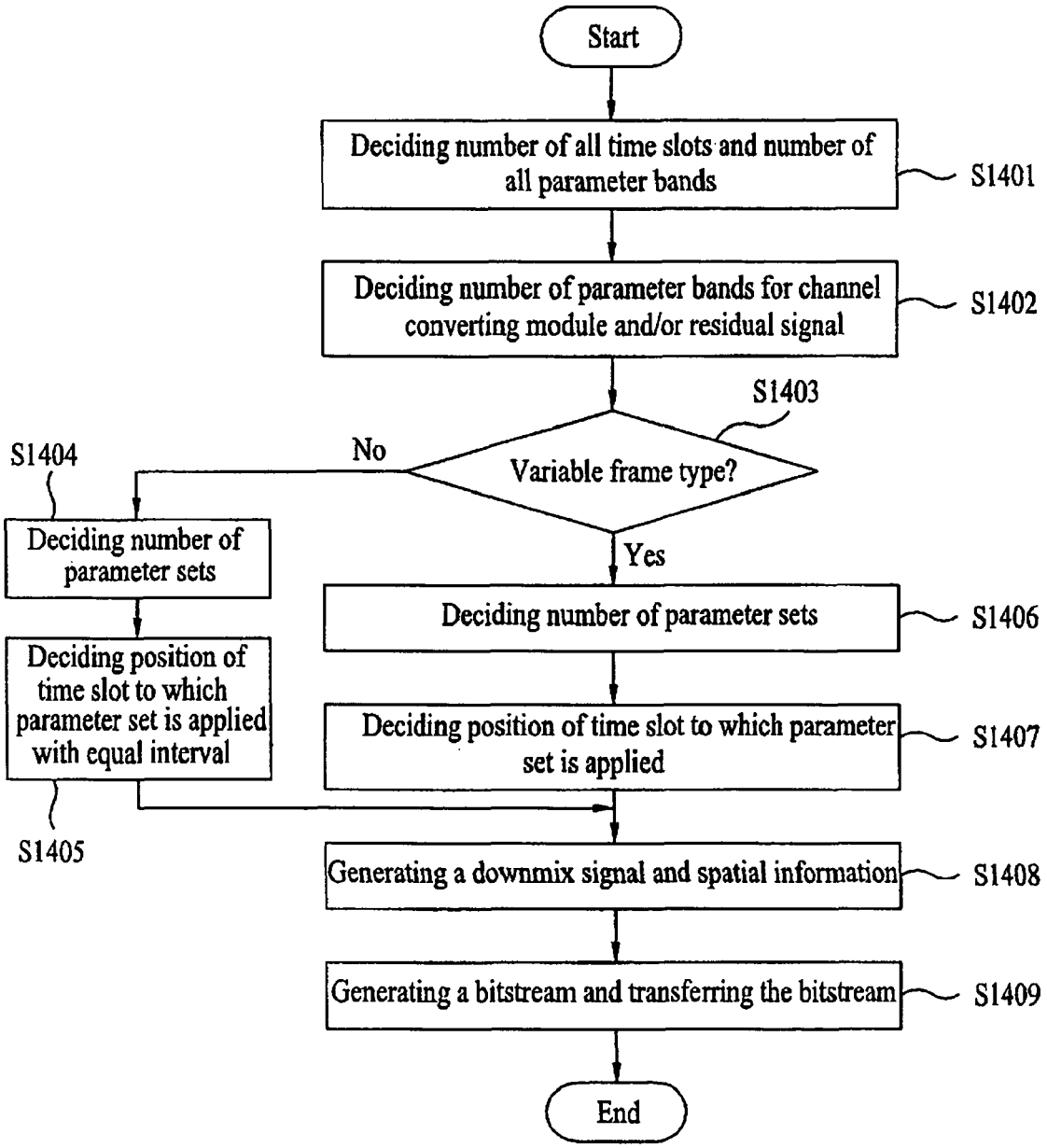
FIG. 14 is a flowchart of an encoding method according to one embodiment of the present invention.

FIG. 14 is a flowchart of an encoding method according to one embodiment of the present invention. A method of encoding an audio signal and an operation of an encoder according to the present invention are explained as follows.

First, a total number of time slots (numSlots) in one spatial frame and a total number of parameter bands (numBands) of an audio signal are determined (S1401).

Then, a number of parameter bands applied to a channel converting module (OTT box and/or TTT box) and/or a residual signal are determined (S1402).

If the OTT box has a LFE channel mode, the number of parameter bands applied to the OTT box is separately determined.

If the OTT box does not have the LFE channel mode, "numBands" is used as a number of the parameters applied to the OTT box.

Subsequently, a type of a spatial frame is determined. In this case, the spatial frame may be classified into a fixed frame type and a variable frame type.

If the spatial frame is the variable frame type (S1403), a number of parameter sets used within one spatial frame is determined (S1406). In this case, the parameter set can be applied to the channel converting module by a time slot unit.

Subsequently, a position of time slot to which the parameter set is applied is determined (S1407).

In this case, the position of time slot to which the parameter set is applied, can be represented as an absolute value and a difference value. For example, a position of a time slot to which a first parameter set is applied can be represented as an absolute value, and a position of a time slot to which a second or higher parameter set is applied can be represented as a difference value from a position of a previous time slot. In this case, the position of a time slot to which the parameter set is applied can be represented by a variable number of bits.

In particular, a position of time slot to which a first parameter set is applied can be represented by a number of bits calculated using a total number of time slots and a total number of parameter sets. A position of a time slot to which a second or higher parameter set is applied can be represented by a number of bits calculated using a total number of time slots, a total number of parameter sets and a position of a time slot to which a previous parameter set is applied.

If the spatial frame is a fixed frame type, a number of parameter sets used in one spatial frame is determined (S1404). In this case, a position of a time slot to which the parameter set is applied is decided using a preset rule. For example, a position of a time slot to which a parameter set is applied can be decided to have an equal interval from a position of a time slot to which a previous parameter set is applied (S1405).

Subsequently, a downmixing unit and a spatial information generating unit generate a downmix signal and spatial information, respectively, using the above-determined total number of time slots, a total number of parameter bands, a number of parameter bands to be applied to the channel converting unit, a total number of parameter sets in one spatial frame and position information of the time slot to which a parameter set is applied (S1408).

Finally, a multiplexing unit generates a bitstream including the downmix signal and the spatial information (S1409) and then transfers the generated bitstream to a decoder (S1409).

Figure 15:
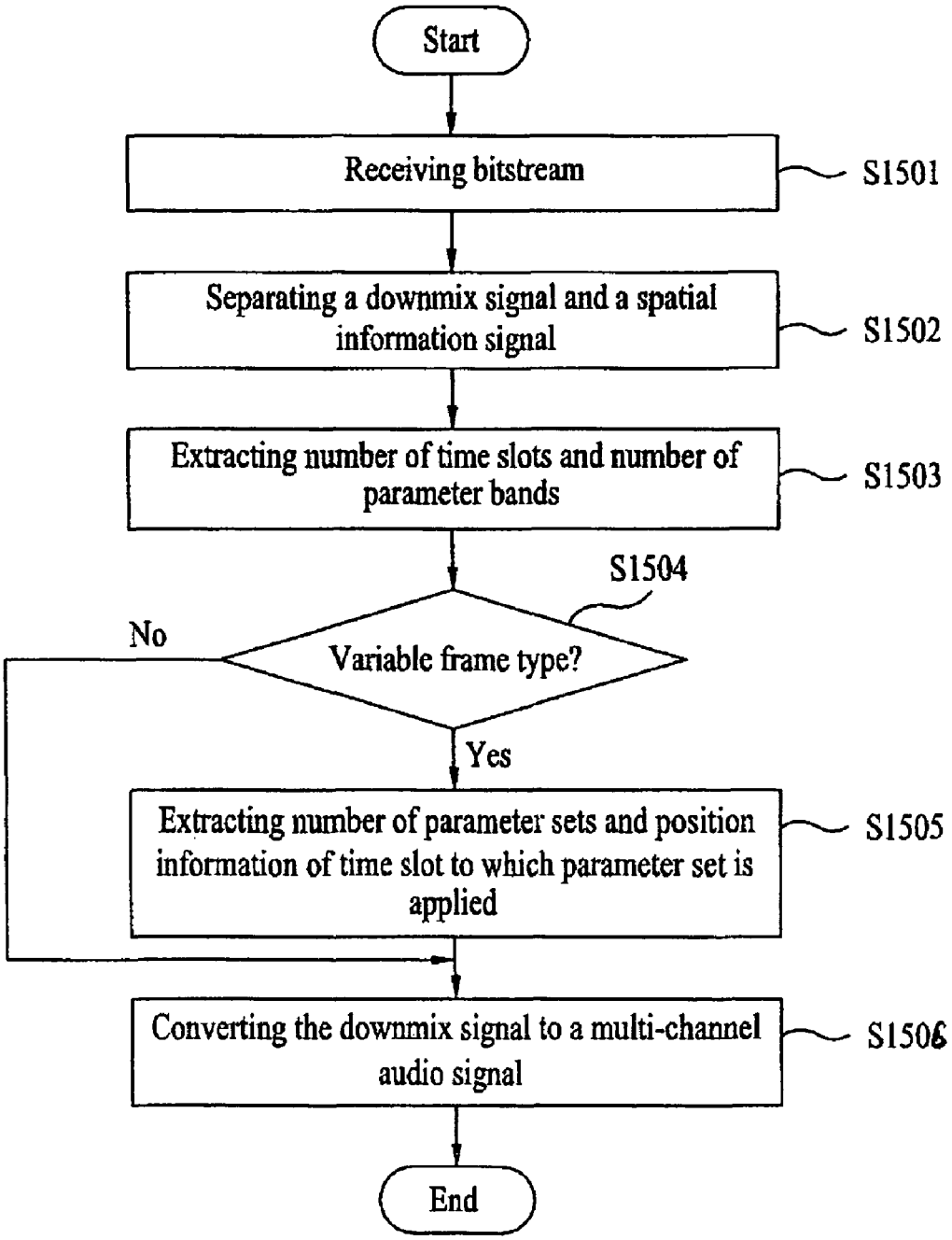
FIG. 15 is a flowchart of a decoding method according to one embodiment of the present invention.

FIG. 15 is a flowchart of a decoding method according to one embodiment of the present invention. A method of decoding an audio signal and an operation of a decoder according to the present invention are explained as follows.

First, a decoder receives a bitstream of an audio signal (S1501). A demultiplexing unit separates a downmix signal and a spatial information signal from the received bitstream (S1502). Subsequently, a spatial information signal decoding unit extracts information for a total number of time slots in one spatial frame, a total number of parameter bands and a number of parameter bands applied to a channel converting module from configuration information of the spatial information signal (S1503).

If the spatial frame is a variable frame type (S1504), a number of parameter sets in one spatial frame and position information of a time slot to which the parameter set is applied are extracted from the spatial frame (S1505). The position information of the time slot can be represented by a fixed or variable number of bits. In this case, position information of time slot to which a first parameter set is applied may be represented as an absolute value and position information of time slots to which a second or higher parameter sets are applied can be represented as a difference value. The actual position information of time slots to which the second or higher parameter sets are applied can be found by adding the difference value to the position information of the time slot to which a previous parameter set is applied.

Finally, the downmix signal is converted to a multi-channel audio signal using the extracted information (S1506).

The disclosed embodiments described above provide several advantages over conventional audio coding schemes.

First, in coding a multi-channel audio signal by representing a position of a time slot to which a parameter set is applied by a variable number of bits, the disclosed embodiments are able to reduce a transferred data quantity.

Second, by representing a position of a time slot to which a first parameter set is applied as an absolute value, and by representing positions of time slots to which a second or higher parameter sets are applied as a difference value, the disclosed embodiments can reduce a transferred data quantity.

Third, by representing a number of parameter bands applied to such a channel converting module as an OTT box and/or a TTT box by a fixed or variable number of bits, the disclosed embodiments can reduce a transferred data quantity. In this case, positions of time slots to which parameter sets are applied can be represented using the aforesaid principle, where the parameter sets may exist in range of a number of parameter bands.

Figure 16:
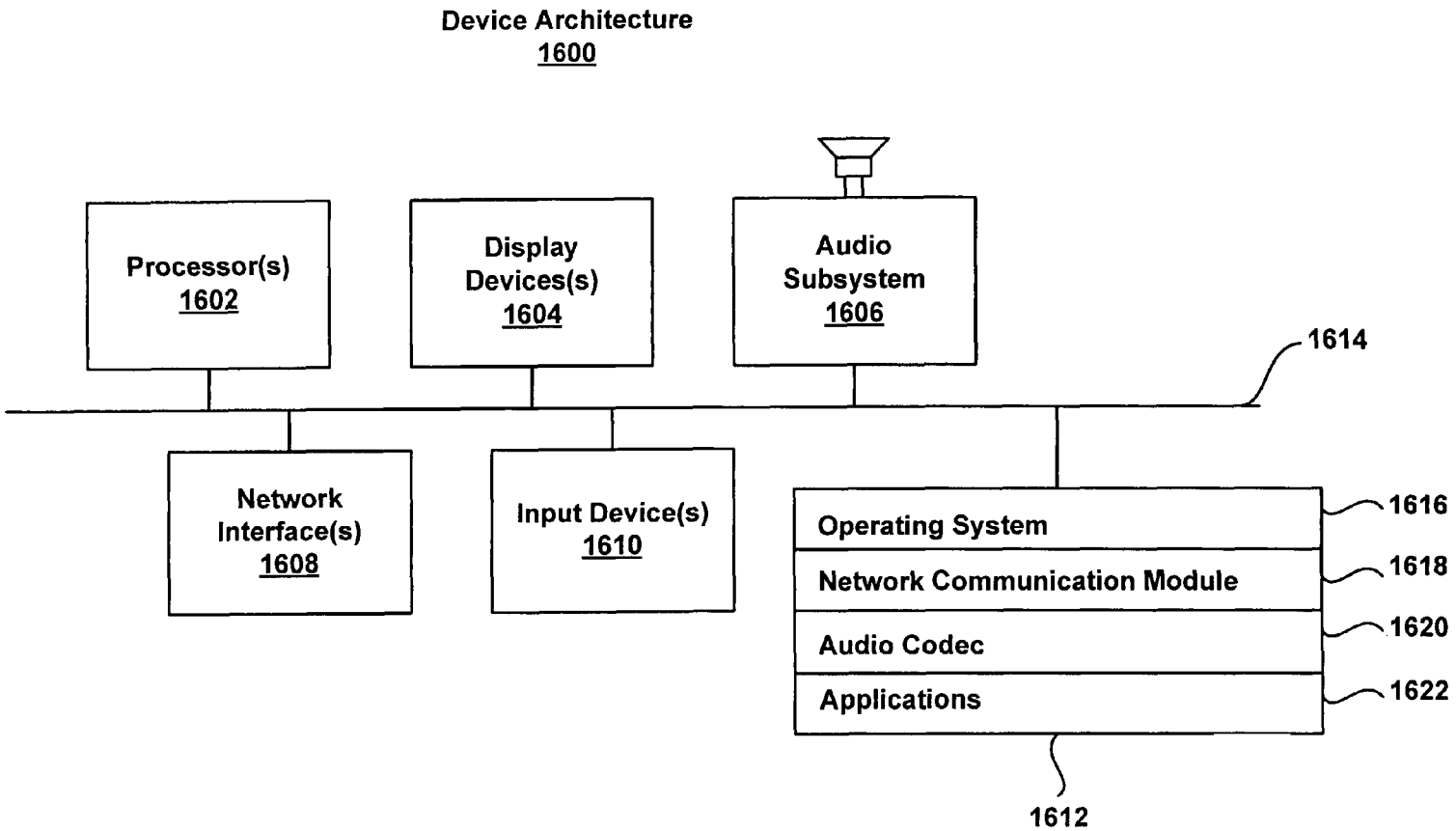
FIG. 16 is a block diagram of a device architecture for implementing the encoding and decoding processes described in reference to FIGS. 1-15.

FIG. 16 is a block diagram of an exemplary device architecture 1600 for implementing the audio encoder/decoder, as described in reference to FIGS. 1-15. The device architecture 1600 is applicable to a variety of devices, including but not limited to: personal computers, server computers, consumer electronic devices, mobile phones, personal digital assistants (PDAs), electronic tablets, television systems, television set-top boxes, game consoles, media players, music players, navigation systems, and any other device capable of decoding audio signals. Some of these devices may implement a modified architecture using a combination of hardware and software.

The architecture 1600 includes one or more processors 1602 (e.g., PowerPC®, Intel Pentium® 4, etc.), one or more display devices 1604 (e.g., CRT, LCD), an audio subsystem 1606 (e.g., audio hardware/software), one or more network interfaces 1608 (e.g., Ethernet, FireWire®, USB, etc.), input devices 1610 (e.g., keyboard, mouse, etc.), and one or more computer-readable mediums 1612 (e.g., RAM, ROM, SDRAM, hard disk, optical disk, flash memory, etc.). These components can exchange communications and data via one or more buses 1614 (e.g., EISA, PCI, PCI Express, etc.).

The term "computer-readable medium" refers to any medium that participates in providing instructions to a processor 1602 for execution, including without limitation, non-volatile media (e.g., optical or magnetic disks), volatile media (e.g., memory) and transmission media. Transmission media includes, without limitation, coaxial cables, copper wire and fiber optics. Transmission media can also-take the form of acoustic, light or radio frequency waves.

The computer-readable medium 1612 further includes an operating system 1616 (e.g., Mac OS®, Windows®, Linux, etc.), a network communication module 1618, an audio codec 1620 and one or more applications 1622.

The operating system 1616 can be multi-user, multiprocessing, multitasking, multithreading, real-time and the like. The operating system 1616 performs basic tasks, including but not limited to: recognizing input from input devices 1610; sending output to display devices 1604 and the audio subsystem 1606; keeping track of files and directories on computer-readable mediums 1612 (e.g., memory or a storage device); controlling peripheral devices (e.g., disk drives, printers, etc.); and managing traffic on the one or more buses 1614.

The network communications module 1618 includes various components for establishing and maintaining network connections (e.g., software for implementing communication protocols, such as TCP/IP, HTTP, Ethernet, etc.). The network communications module 1618 can include a browser for enabling operators of the device architecture 1600 to search a network (e.g., Internet) for information (e.g., audio content).

The audio codec 1620 is responsible for implementing all or a portion of the encoding and/or decoding processes described in reference to FIGS. 1-15. In some embodiments, the audio codec works in conjunction with hardware (e.g., processor(s) 1602, audio subsystem 1606) to process audio signals, including encoding and/or decoding audio signals in accordance with the present invention described herein.

The applications 1622 can include any software application related to audio content and/or where audio content is encoded and/or decoded, including but not limited to media players, music players (e.g., MP3 players), mobile phone applications, PDAs, television systems, set-top boxes, etc. In one embodiment, the audio codec can be used by an application service provider to provide encoding/decoding services over a network (e.g., the Internet).

In the above description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

In particular, one skilled in the art will recognize that other architectures and graphics environments may be used, and that the present invention can be implemented using graphics tools and products other than those described above. In particular, the client/server approach is merely one example of an architecture for providing the dashboard functionality of the present invention; one skilled in the art will recognize that other, non-client/server approaches can also be used.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and modules presented herein are not inherently related to any particular computer or other apparatus. Various general-purpose systems may be used with programs in accordance with the teachings herein, or it may prove convenient to construct more specialized apparatuses to perform the method steps. The required structure for a variety of these systems will appear from the description below. In addition, the present invention is not described with reference to any particular programming language. It will be appreciated that a variety of programming languages may be used to implement the teachings of the invention as described herein. Furthermore, as will be apparent to one of ordinary skill in the relevant art, the modules, features, attributes, methodologies, and other aspects of the invention can be implemented as software, hardware, firmware or any combination of the three. Of course, wherever a component of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present invention is in no way limited to implementation in any specific operating system or environment.

It will be apparent to those skilled in the art that various modifications and variations can be made to the disclosed embodiments without departing from the spirit or scope of the invention. Thus, it is intended that the present invention covers all such modifications to and variations of the disclosed embodiments, provided such modifications and variations are within the scope of the appended claims and their equivalents.

What is claimed is:

1. A method of decoding an audio signal performed by an audio coding system, the audio signal including a downmix signal and spatial information, the spatial information including a residual signal, comprising:

extracting time slot information in variable bit length and residual band information in fixed bit length, the time slot information indicating a time slot to which a parameter set is applied and the residual band information indicating a number of parameter bands to which the residual signal is applied;

updating a parameter of the parameter set by using the residual signal based on the residual band information, the parameter set including inter-channel correlation information; and decoding the audio signal by using the parameter set including the updated parameter based on the time slot information, wherein the process of extracting time slot information further comprises:

extracting a number of time slots and a number of parameter sets from the audio signal to identify time slot information;

determining a bit length of the time slot information, the bit length being variable according to the number of time slots, the number of parameter sets and previous time slot information associated with a previous parameter set; and extracting the time slot information based on the bit length, wherein a number of the time slot information is equal to the number of parameter sets.

2. The method of claim 1, wherein the time slot information is position information indicating a position of a time slot to which a parameter set is applied.

3. The method of claim 1, wherein the time slot information includes an absolute value for indicating a time slot to which a first parameter set is applied or a difference value for indicating a time slot to which a following parameter set of the first parameter set is applied, and wherein the time slot to which the following parameter set is applied is determined by adding the difference value to the previous time slot information.

4. An apparatus for decoding an audio signal, the audio signal including a downmix signal and spatial information, the spatial information including a residual signal, comprising:

a processor comprising a signal receiving unit, a spatial information obtaining unit and an upmixing unit, wherein the signal receiving unit is operable for receiving a residual signal, a downmix signal and spatial information, and wherein the spatial information obtaining unit is operable for obtaining parameter set, time slot information corresponding to the parameter set and residual band information indicating the number of parameter bands corresponding to the residual signal, and updating a parameter of the parameter set by using the residual signal based on the residual band information, the parameter set including inter-channel correlation information, and wherein the upmixing unit is operable for decoding the downmix signal by using the parameter set including the updated parameter based on the time slot information, wherein a bit length of the time slot information is determined based on a number of time slots, a number of parameter sets, and previous time slot information associated with a previous parameter set.

5. The apparatus of claim 4, wherein the time slot information is position information indicating a position of a time slot to which a parameter set is applied.

6. The apparatus of claim 4, wherein the time slot information includes an absolute value for indicating a time slot to which a first parameter set is applied or a difference value for indicating a time slot to which a following parameter set of the first parameter set is applied, and wherein the time slot to which the following parameter set is applied is determined by adding the difference value to the previous time slot information.

* * * * *